US008387580B2

(12) United States Patent
Aida et al.

(10) Patent No.: US 8,387,580 B2
(45) Date of Patent: Mar. 5, 2013

(54) PLASMA IGNITION DEVICE FOR INTERNAL COMBUSTION ENGINE

(75) Inventors: Futoshi Aida, Chiyoda-ku (JP); Yusuke Naruse, Chiyoda-ku (JP); Hiroshi Okuda, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 532 days.

(21) Appl. No.: 12/760,223

(22) Filed: Apr. 14, 2010

(65) Prior Publication Data

US 2011/0106395 A1 May 5, 2011

(30) Foreign Application Priority Data

Oct. 29, 2009 (JP) ..... 2009-249072

(51) Int. Cl.
*F02P 3/06* (2006.01)
*F02P 11/00* (2006.01)

(52) U.S. Cl. ..... 123/143 B; 123/605; 123/623; 123/630

(58) Field of Classification Search ..... 123/143 R, 123/143 B, 596, 605, 623, 630
See application file for complete search history.

(56) References Cited

U.S. PATENT DOCUMENTS

| | | | | |
|---|---|---|---|---|
| 4,562,823 | A * | 1/1986 | Moritugu et al. | 123/620 |
| 7,924,081 | B2 * | 4/2011 | Lorenzo et al. | 327/376 |
| 8,096,276 | B2 * | 1/2012 | Aida et al. | 123/143 B |

FOREIGN PATENT DOCUMENTS

| | | | |
|---|---|---|---|
| JP | 56-123490 | U | 9/1981 |
| JP | 11-270387 | A | 10/1990 |
| JP | 5-231281 | A | 9/1993 |
| JP | 07-217518 | A | 8/1995 |
| JP | 07-286572 | A | 10/1995 |
| WO | 2009/088045 | A1 | 7/2009 |

OTHER PUBLICATIONS

Japanese Office Action dated Sep. 11, 2012 issued in corresponding Japanese Patent Application No. 2009-249072.
Japanese Office Action dated Sep. 20, 2011 issued in a corresponding Japanese Patent Application No. 2009-249072.

* cited by examiner

*Primary Examiner* — Thomas Moulis
(74) *Attorney, Agent, or Firm* — Sughrue Mion, PLLC

(57) ABSTRACT

A plasma ignition device comprising: an ignition plug; an ignition circuit applying a high voltage to the plug to start discharge; a power supply circuit including a battery section for supplying an electric energy to a discharge space of the plug having impedance reduced by discharge start, and a charging section charging the battery section with a boosted voltage by a booster circuit, wherein the power supply circuit including: a first means 610 for stopping a boosting operation of the booster circuit when the charging section voltage is equal or higher than a first reference for high-voltage abnormality; a second means 630 for detecting the charging section abnormal voltage by comparison with a second reference for low-voltage abnormality for detecting ground to conduct a given control on the power supply circuit; a third means 600 for invalidating the control of the second means until the charging section is sufficiently charged.

15 Claims, 20 Drawing Sheets

61

62

63

17

PLASMA IGNITION DEVICE FOR INTERNAL COMBUSTION ENGINE

BACKGROUND OF THE INVENTION

1. Field of the Invention

The present invention relates to a plasma ignition device for an internal combustion engine, and more particularly, to output abnormality detection in a power supply circuit.

2. Description of the Related Art

Up to now, in a power supply circuit for an internal combustion engine ignition device, a tank capacitor connected in parallel to an ignition plug is charged by a booster circuit, and a voltage detector circuit outputs a given signal upon detecting that a charging voltage of the tank capacitor reaches a given voltage. The operation of the booster circuit stops in response to that signal to stabilize the charging voltage of the tank capacitor (for example, refer to JP 05-231281 A).

However, in the case where a center electrode is grounded by a current leakage from an ignition plug connected to an output unit, or the like, resulting in the occurrence of an output abnormality (hereinafter, referred to as "at the time of ground"), a charging voltage of the tank capacitor does not reach the given voltage, and the voltage detector circuit does not output the given signal. For that reason, the booster circuit continues to operate, thereby causing such a problem that electronic parts such as a transformer or a field effect transistor (FET) of the booster circuit are broken down.

Further, when a request output of an ignition coil is increased by the ignition plug covered with gasoline or the like to cause an accidental fire, and an abnormal output occurs (hereinafter, referred to as "at the time of accidental fire"), an output voltage of the ignition coil is applied between the tank capacitor and the ignition plug in a backward direction of a high-voltage diode inserted in a direction from the tank capacitor to the ignition plug as a forward direction, thereby resulting in a risk that the high-voltage diode is broken down.

SUMMARY OF THE INVENTION

The present invention has been made to solve the above-mentioned problem, and therefore aims to provide a plasma ignition device for an internal combustion engine, which reduces a damage exerted on a booster circuit or a high-voltage diode.

A plasma ignition device for an internal combustion engine according to the present invention includes: an ignition plug for the internal combustion engine; an ignition circuit that is connected in parallel to the ignition plug, and applies a high voltage to the ignition plug to start discharge; and a power supply circuit that is connected in parallel to the ignition plug, including a battery section that generates a plasma current for supplying an electric energy to a discharge space of the ignition plug having impedance reduced by discharge start, and a charging section that charges the battery section with a voltage boosted by a booster circuit, in which the power supply circuit includes: a voltage limit control section that stops a boosting operation of the booster circuit when a voltage of the charging section is equal to or higher than a first reference voltage for high-voltage abnormality detection as a result of comparison with the first reference voltage; a low-voltage abnormality detection control section that detects an abnormal voltage of the charging section by comparison with a second reference voltage for low-voltage abnormality detection for detecting ground to conduct a given control on the power supply circuit; and a control limiter section that invalidates the given control of the low-voltage abnormality detection control section until the charging section is sufficiently charged.

According to the present invention, at the time of ground, electronic parts such as a transformer or a field effect transistor (FET) within the booster circuit may be prevented from being broken down by reaching the given voltage, detecting the abnormal output, outputting the voltage detection signal, and stopping the operation of the booster circuit. Further, at the time of accidental fire, a load on the high-voltage diode may be reduced by suppressing a reverse voltage applied to the high-voltage diode with stopping the operation of the ignition coil.

DETAILED DESCRIPTION OF THE PREFERRED EMBODIMENTS

Hereinafter, a description is given of a plasma ignition device for an internal combustion engine according to preferred embodiments of the present invention with reference to the drawings. In the respective embodiments, identical or corresponding parts are denoted by the same or like reference symbols, and their description is omitted.

First Embodiment

Figure 1:
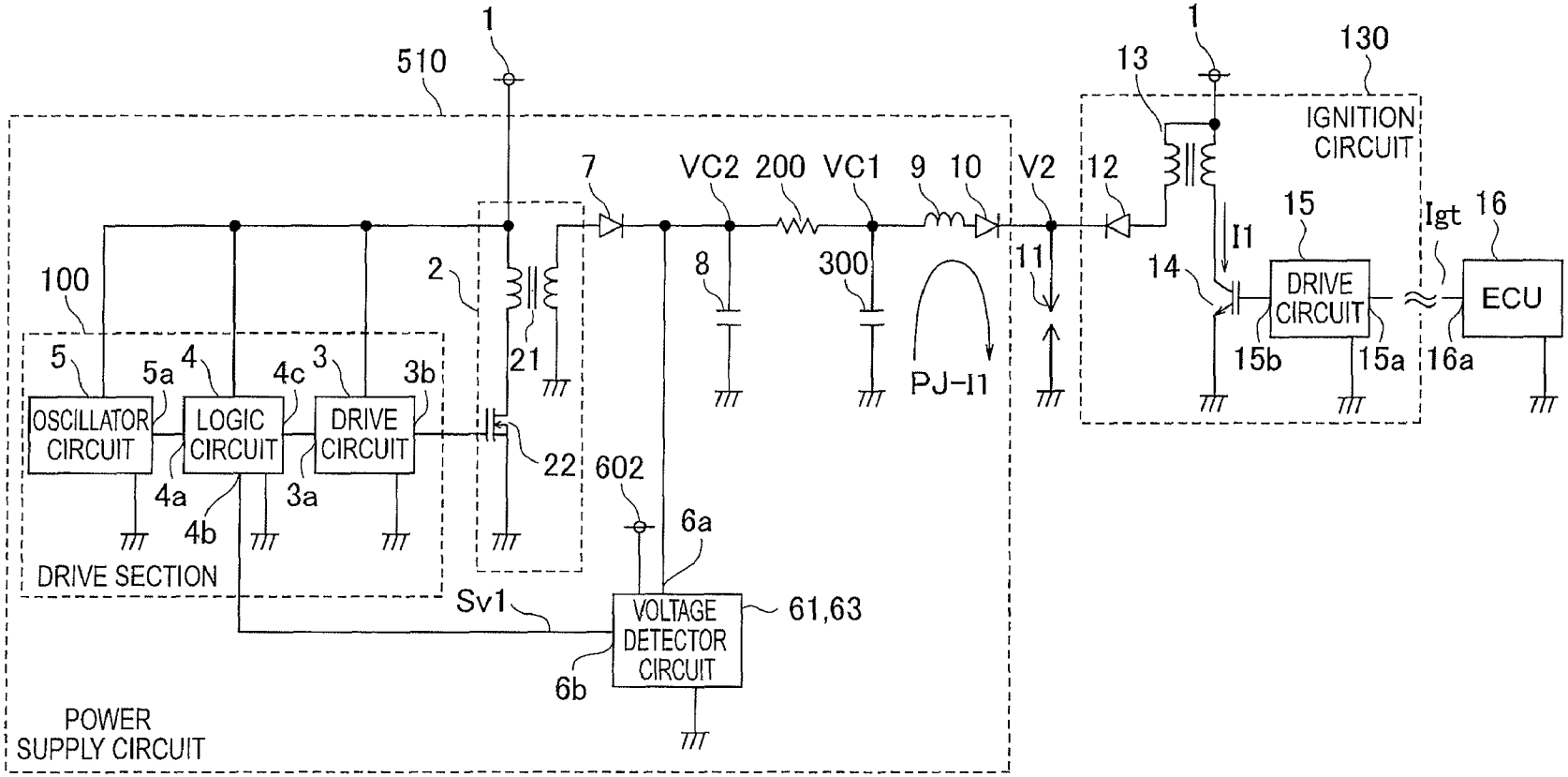
FIG. 1 is a circuit configuration diagram illustrating a plasma ignition device for an internal combustion engine according to first and second embodiments of the present invention.

FIG. 1 is a circuit configuration diagram illustrating a plasma ignition device for an internal combustion engine according to a first embodiment of the present invention. Referring to FIG. 1, the plasma ignition device includes an ignition plug 11, an ignition circuit 130 including an ignition coil 13 that generates a high voltage for generating discharge in a discharge space of the ignition plug 11, and a power supply circuit 510 that generates a plasma current PJ-I1 for developing the plasma by supplying an electric energy to the discharge space whose impedance is decreased by discharge start. The ignition coil 13 (ignition circuit 130), the power supply circuit 510, and the ignition plug 11 are connected in parallel to each other.

The power supply circuit 510 includes a booster circuit 2, a drive circuit 3, a logic circuit 4, an oscillator circuit 5, a voltage detector circuit 61, a rectifier diode 7, a tank capacitor 8, a current limit resistor 200, a PJ capacitor 300 that generates a plasma current, an inductor 9, and a high-voltage diode 10. The booster circuit 2, the drive circuit 3, the logic circuit 4, and the oscillator circuit 5 are fed by a battery power supply 1, and the voltage detector circuit 61 is fed by the battery power supply 1, or an internal power supply 602 derived from the battery power supply 1. Further, the drive circuit 3, the logic circuit 4, and the oscillator circuit 5 constitute a drive section 100.

The drive circuit 3 includes an output terminal 3*b* connected to a gate terminal of a metal oxide semiconductor field effect transistor (MOSFET) 22 within the booster circuit 2, and an input terminal 3*a* connected to an output terminal 4*c* of the logic circuit 4. The logic circuit 4 includes an input terminal 4*a* connected to an output terminal 5*a* of the oscillator circuit 5, and an input terminal 4*b* connected to an output terminal 6*b* of the voltage detector circuit 61.

An input terminal 6*a* of the voltage detector circuit 61 is connected to a cathode side of the rectifier diode 7, a higher voltage side of the tank capacitor 8, and one end of the current limit resistor 200. Another end of the tank capacitor 8 is connected to a ground terminal GND. Another end of the current limit resistor 200 is connected to the higher voltage side of the JP capacitor 300, and one end of the inductor 9. Another end of the PJ capacitor 300 is connected to the ground terminal GND. Another end of the inductor 9 is connected to an anode side of the high-voltage diode 10. A cathode side of the high-voltage diode 10 is connected to the ignition plug 11.

The booster circuit 2 includes a transformer 21, and a MOSFET 22 connected in series to a primary coil of the transformer 21. The primary coil of the transformer 21 is connected between the battery power supply 1 and a drain terminal of the MOSFET 22, and the secondary coil is connected between an anode side of the rectifier diode 7 being an output of the booster circuit 2 and the ground terminal GND. A source terminal of the MOSFET 22 is connected to the ground terminal GND.

Further, the booster circuit 2, the tank capacitor 8, and the current limit resistor 200 function to charge the PJ capacitor 300. For that reason, a capacitance value of the tank capacitor 8 is set to be higher than the capacitance value of the PJ capacitor 300.

Further, in the ignition circuit 130, an output terminal 16*a* of an electronic control unit (ECU) 16 is connected to an input terminal 15*a* of the drive circuit 15. A primary coil of the ignition coil 13 is connected in series with, for example, an insulated gate bipolar transistor (IGBT) 14 being an insulating gate transistor. The primary coil of the ignition coil 13 is connected between the battery power supply 1 and a collector terminal of the IGBT 14, and a secondary coil thereof is connected between the battery power supply 1 and an anode side of the rectifier diode 12. A cathode side of the rectifier diode 12 is connected to the ignition plug 11. A gate of the IGBT 14 is connected to an output terminal 15*b* of the drive circuit 15, and an emitter terminal thereof is connected to the ground terminal GND.

Figure 2:
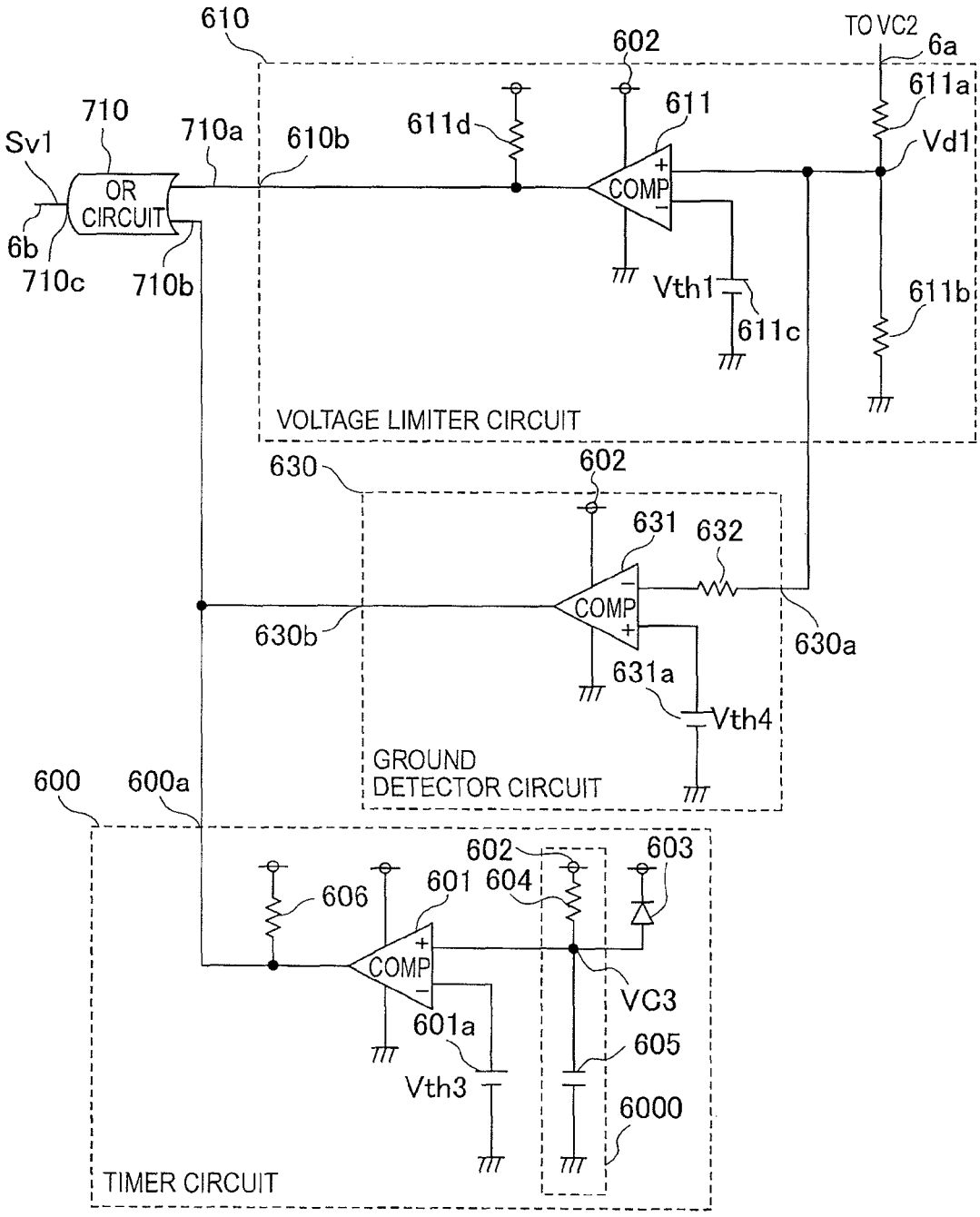
FIG. 2 is a diagram illustrating an example of a circuit configuration of a voltage detector circuit illustrated in FIG. 1.

FIG. 2 illustrates an example of the circuit configuration of the voltage detector circuit 61 illustrated in FIG. 1. The voltage detector circuit 61 includes a voltage limiter circuit 610, a timer circuit 600, a ground detector circuit 630, and an OR circuit 710.

In the voltage limiter circuit 610, a charging voltage VC2 of the tank capacitor 8 illustrated in FIG. 1, which is applied to the input terminal 6*a*, is divided by series resistors 611*a* and 611*b* which are connected in series. To a comparator 611 connected between the internal power supply 602 and the ground terminal GND is input a divided voltage Vd1 being a detection voltage and a reference voltage Vth1 of a reference power supply 611*c* for comparison. An output terminal 610*b* of the voltage limiter circuit 610 being an output terminal of the comparator 611 is connected with a pull-up resistor 611*b*.

The comparator 611 outputs, when the divided voltage Vd1 becomes equal to or higher than the reference voltage Vth1, a voltage detection signal of an H level from the output terminal 610*b* of the voltage limiter circuit 610.

In the timer circuit 600, a time constant circuit 6000 includes a series circuit including a resistor 604 and a capacitor 605 which are connected between the internal power supply 602 and the ground terminal GND. After the internal power supply 602 turns on, a current flows in the capacitor 605 through the resistor 604 from the internal power supply 602 to charge the capacitor 605 (charging voltage VC3). To a comparator 601 connected between the power supply 602 and the ground terminal GND are input a charging voltage VC3 at a connection point of the resistor 604 and the capacitor 605 in the time constant circuit 6000, and a reference voltage Vth3 of the reference power supply 601*a* for comparison. An output terminal 600*a* of the timer circuit 600 being an output terminal of the comparator 601 is connected with a pull-up resistor 606. Further, between a connection point of the resistor 604 and the capacitor 605 in the time constant circuit 6000 and the internal power supply is connected a rectifier diode 603 having a forward direction from the connection point toward the internal power supply.

When the charging voltage VC3 becomes equal to or higher than the reference voltage Vth3, the comparator 601 outputs a voltage detection signal of the H level from the output terminal 600*a* of the timer circuit 600, and a voltage is applied to an output terminal 630*b* of the ground detector circuit 630 through the pull-up resistor 606 by the internal power supply 602. After the internal power supply 602 has turned on, the timer circuit 600 outputs a voltage signal of an L level from the output terminal 600*a*, and holds the voltage level of the output terminal 630*b* of the ground detector circuit 630 at the L level until the tank capacitor 8 and the PJ capacitor 300 are sufficiently charged. For that reason, a constant of the resistor 604 and the capacitor 605 within the time constant circuit 6000 is set so that the charging voltage VC3 becomes equal to or higher than the reference voltage Vth3 when the tank capacitor 8 and the PJ capacitor 300 have been sufficiently charged after the internal power supply 602 has turned on. Further, after the rectifier diode 603 has stopped feeding from the internal power supply 602, the rectifier diode 603 removes electric charges accumulated in the capacitor 605 after the internal power supply 602 has turned on, and prepares for the normal operation of the timer circuit 600 when the internal power supply 602 turns on next time.

In the ground detector circuit 630, to a comparator 631 connected between the power supply 602 and the ground terminal GND is input the divided voltage Vd1 of the voltage limiter circuit 610 from an input terminal 630*a* through an input resistor 632. Further, a reference voltage Vth4 of the reference power supply 631*a* is input to the comparator 631. An output terminal of the comparator 631*a* is an output terminal 630*b* of the ground detector circuit 630.

The comparator 631 compares the divided voltage Vd1 of the charging voltage VC2 of the tank capacitor 8 with the reference voltage Vth4. When the divided voltage Vd1 is equal to or lower than the reference voltage Vth4, the comparator 631 outputs a voltage detection signal of the H level from the output terminal 630*b* of the ground detector circuit 630.

Once the voltage detection signal of the H level is output from the output terminal 630*b* of the ground detector circuit 630, the operation of the booster circuit 2 does not restart after the ground detection unless the internal power supply 602 is reset (stated order of on, off, and on; the timer circuit 600 restarts) (latch control). That is, the charging voltage VC2 is not increased unless the operation of the booster circuit 2 restarts, and hence the output of the ground detector circuit 630 is held at the H level. As a result, the outputs of the ground detector circuit 630 and the timer circuit 600 are held at the H level unless the supply voltage of the internal power supply 602 is decreased, and hence the OR circuit 710 continues to output the voltage detection signal Sv1 of the H level, and does not allow the booster circuit 2 to operate.

Then, one input terminal 710*a* of the OR circuit 710 is connected with an output terminal 610*b* of the voltage limiter circuit 610, and another input terminal 710*b* thereof is connected with both of the output terminal 630*b* of the ground detector circuit 630 and the output terminal 600*a* of the timer circuit 600. The OR circuit 710 outputs the voltage detection signal Sv1 of the H level to the output terminal 710*c* when the voltage detection signal of the H level is input to any one of the input terminals of the OR circuit 710. The voltage detection signal Sv1 is input to the logic circuit 4 illustrated in FIG. 2.

In the drive section 100, a periodic signal from the oscillator circuit 5 is normally input to the drive circuit 3 through the logic circuit 4. The drive circuit 3 conducts the on/off control of the MOSFET 22 of the booster circuit 2 according to the periodic signal to perform boosting operation. Then, upon receiving the voltage detection signal Sv1 of the H level, the logic circuit 4 blocks the periodic signal from the drive circuit 3, stops the control operation of the drive circuit 3, and stops the boosting operation of the booster circuit 2.

Note that, the PJ capacitor 300 constitutes a battery section, the booster circuit 2, the tank capacitor 8, and the current limit resistor 200 constitute a charging section, the voltage limiter circuit 610 and the drive section 100 constitute a voltage limit control section, the ground detector circuit 630 and the drive section constitute a low-voltage abnormality detection control section, and the timer circuit 600 constitutes a control limiter section.

Figure 3:
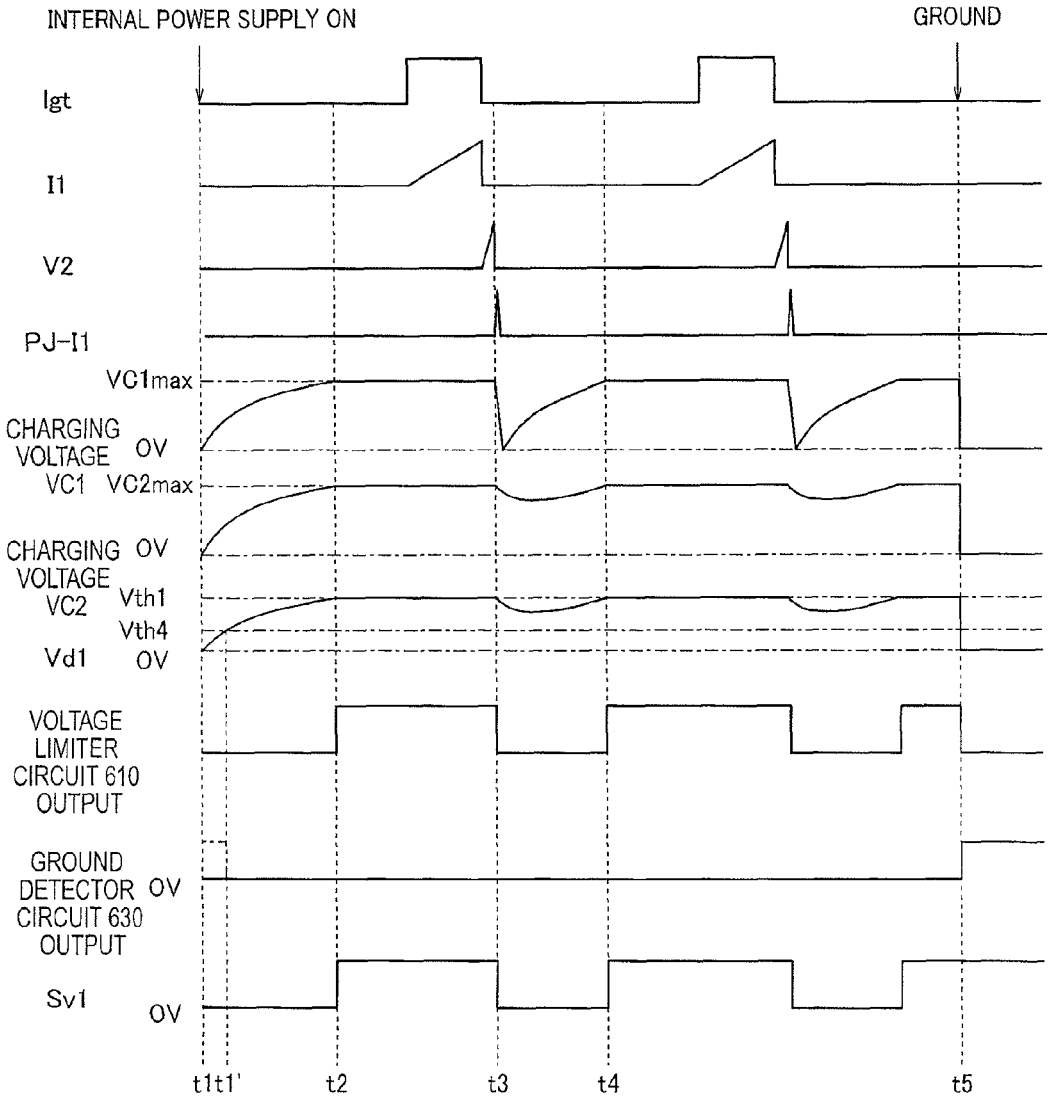
FIG. 3 is a timing chart illustrating an operation of the respective parts of the plasma ignition device according to the first embodiment of the present invention.

FIG. 3 illustrates a timing chart of the operation of the respective parts of the plasma ignition device according to the first embodiment of the present invention. Hereinafter, the operation is described. At a time point t1, when the internal power supply 602 turns on by feeding from the battery power supply 1, the booster circuit 2 within the power supply circuit 510 starts the operation, and charges the tank capacitor 8 and the PJ capacitor 300. Note that, for example, when no timer circuit 600 is incorporated into the voltage detector circuit 61, the divided voltage Vd1 becomes lower than the reference voltage Vth4 at the time points t1 to t1' while the tank capacitor 8 is being initially charged, because the charging voltage VC2 is a low voltage. For that reason, the output of the ground detector circuit 630 becomes a voltage signal of the H level as indicated by a broken line, and it is impossible to stop the operation of the booster circuit 2 and normally operate the power supply circuit 510. For that reason, there is a need to mask (hold) the output of the ground detector circuit 630 at the L level by the timer circuit 600 during the initial charging of the tank capacitor 8.

At a time point t2, when the charging voltage VC2 of the tank capacitor 8 reaches VC2max, the divided voltage Vd1 becomes equal to or higher than the reference voltage Vth1. As a result, the voltage limiter circuit 610 outputs the voltage detection signal of the H level, and hence the OR circuit 710 outputs the voltage detection signal Sv1 of the H level to stop the operation of the booster circuit 2.

After that, in the ignition circuit 130, for example, the drive circuit 15 conducts the on/off control of the IGBT 14 according to an ignition signal Igt from the ECU 16. Then, a high voltage V2 is generated at the secondary side by rapidly changing the primary current I1 of the ignition coil 13.

At a time point t3, when the high voltage V2 is applied to the ignition plug 11 by the ignition coil 13 to cause breakdown, discharge starts. Electric energy is supplied from the power supply circuit 510 to a discharge space whose impedance is decreased by discharge start, and the plasma is generated. As a result, the plasma current PJ-I1 is allowed to flow. The electric charges accumulated in the PJ capacitor 300 and the tank capacitor 8 are removed by allowing the plasma current PJ-I1 to flow. As a result, the charging voltage VC1 of the PJ capacitor 300 and the charging voltage VC2 of the tank capacitor 8 are decreased. Then, in the voltage limiter circuit 610 of the voltage detector circuit 61 illustrated in FIG. 2, the divided voltage Vd1 becomes lower than the reference voltage Vth1, and the voltage limiter circuit 610 outputs the voltage detection signal of the L level. As a result, the OR circuit 710 outputs the voltage detection signal Sv1 of the L level to start the operation of the booster circuit 2.

At a time point t4, when the charging voltage VC2 of the tank capacitor 8 reaches VC2max, the divided voltage Vd1 becomes equal to or higher than the reference voltage Vth1, and the voltage limiter circuit 610 outputs the voltage detection signal of the H level. As a result, the OR circuit 710 outputs the voltage detection signal Sv1 of the H level to stop the operation of the booster circuit 2. After that, the above-mentioned operation is repeated.

After that, at a time point t5, when grounding occurs in the ignition plug 11, the charging voltage VC1 of the PJ capacitor 300 becomes 0 V, and the charging voltage VC2 of the tank capacitor 8 is also decreased. As a result, in the ground detector circuit 630, the divided voltage Vd1 becomes equal to or lower than the reference voltage Vth4, and the ground detector circuit 630 outputs the voltage detection signal of the H level. As a result, the OR circuit 710 outputs the voltage detection signal Sv1 of the H level to stop the operation of the booster circuit 2.

With the above-mentioned system, at the time of occurrence of ground, the divided voltage Vd1 applied to the ground detector circuit 630 drops down to the reference voltage Vth4 or lower. As a result, the abnormal output is detected, and the voltage detection signal Sv1 of the H level is output. Therefore, at the time of ground, the operation of the booster circuit 2 is stopped, thereby enabling the electronic parts such as the transformer 21 or the MOSFET 22 in the booster circuit 2 to be prevented from being broken down.

Figure 4:
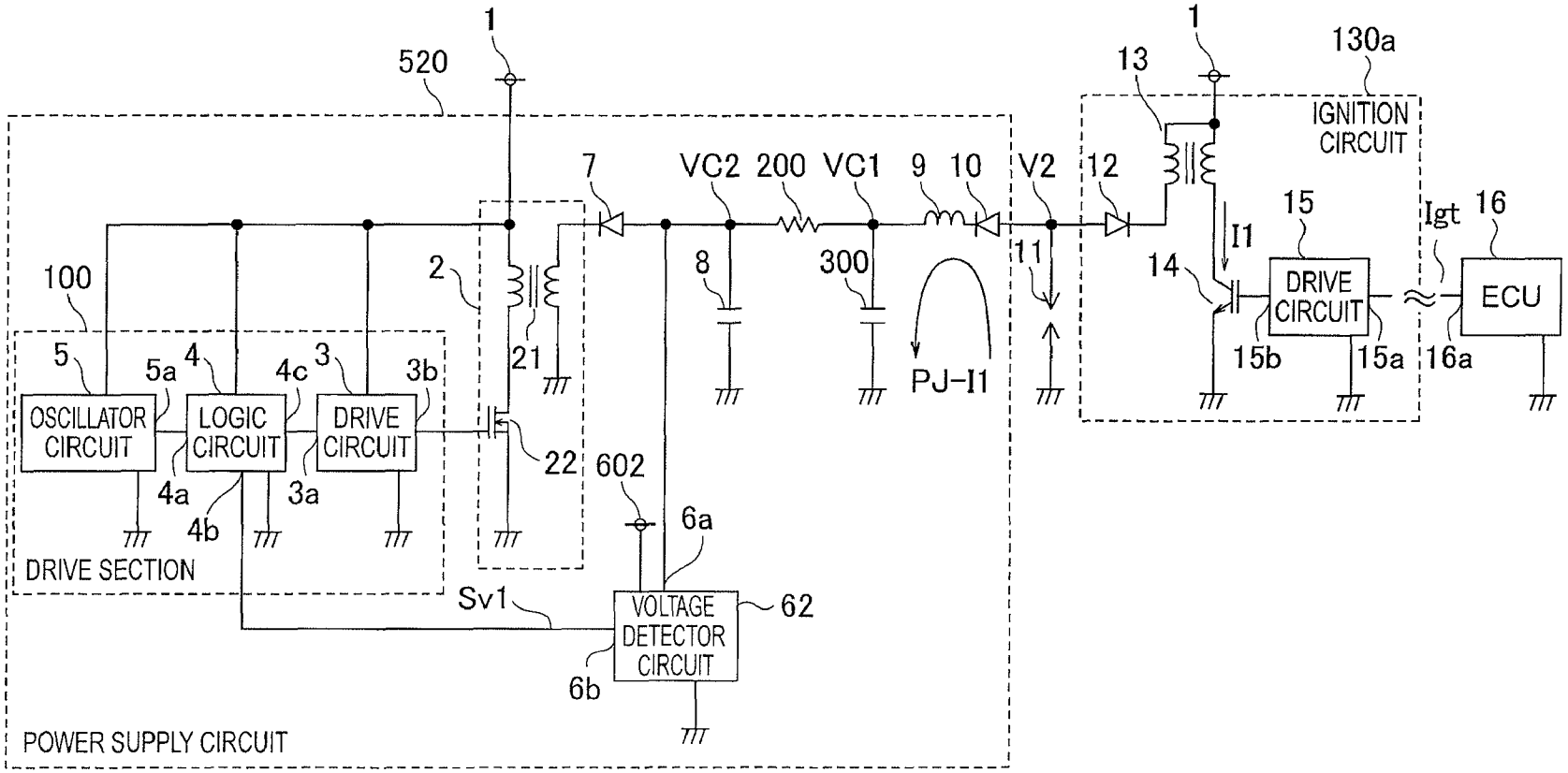
FIG. 4 is a circuit configuration diagram illustrating the plasma ignition device at the time of a negative bias according to the first and second embodiments of the present invention.
Figure 5:
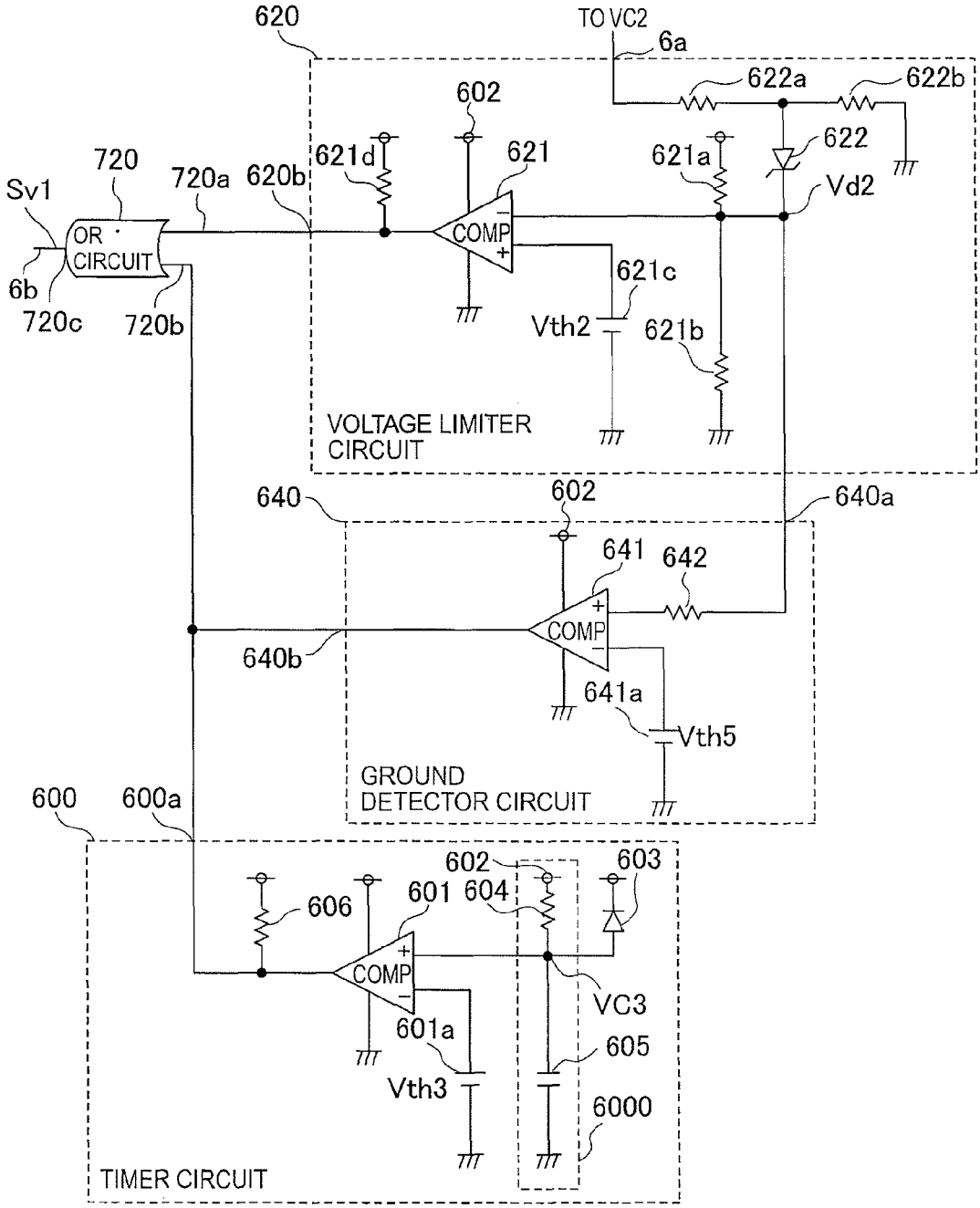
FIG. 5 is a diagram illustrating an example of a circuit configuration of a voltage detector circuit illustrated in FIG. 4.

FIG. 4 illustrates the circuit configuration diagram of the plasma ignition device at the time of a negative bias according to this embodiment, and FIG. 5 illustrates an example of the circuit configuration of a voltage detector circuit 62 illustrated in FIG. 4.

FIG. 4 is different from FIG. 1 in the configuration of the voltage detector circuit 62 illustrated in detail in FIG. 5 in a power supply circuit 520, and also in that the direction of the rectifier diode 7 and the high-voltage diode 20 is opposite to that in FIG. 1. Further, the direction of the plasma current PJ-I1 is also opposite thereto.

The voltage detector circuit 62 illustrated in FIG. 5 includes a voltage limiter circuit 620, the timer circuit 600, a ground detector circuit 640, and an OR circuit 720.

A comparator 621 compares a detection voltage Vd2 determined by detecting the charging voltage VC2 of the tank capacitor 8 by series resistors 622*a* and 622*b*, a zener diode 622, and series resistors 621*a* and 621*b* with the reference voltage Vth2 of the reference power supply 621*c*. When the detection voltage Vd2 becomes equal to or lower than the reference voltage Vth2, the comparator 621 supplies the voltage detection signal of the H level to an input terminal 720*a* of the OR circuit 720 from an output terminal 620*b* of the voltage limiter circuit 620. When the voltage detection signal of the H level is supplied to the input terminal 720*a*, the OR circuit 720 inputs the voltage detection signal Sv1 of the H level to the logic circuit 4 illustrated in FIG. 4 from the output terminal 720*c*. As a result, the logic circuit 4 stops the operation of the booster circuit 2 through the drive circuit 3.

The timer circuit 600 is identical with the timer circuit 600 illustrated in FIG. 2 in the circuit configuration and the operation principle.

The ground detector circuit 640 includes a comparator 641, an input resistor 642, and a reference power supply 641*a* that outputs a reference voltage Vth5.

The comparator 641 compares the detection voltage Vd2 with a reference voltage Vth5. When the detection voltage Vd2 becomes equal to or higher than the reference voltage Vth5, the comparator 641 supplies the voltage detection signal of the H level to an input terminal 720*b* of the OR circuit 720 from the output terminal 640*b* of the ground detector circuit 640. When the voltage detection signal of the H level is supplied to the input terminal 720*b*, the OR circuit 720 inputs the voltage detection signal Sv1 of the H level to the logic circuit 4 illustrated in FIG. 4 from the output terminal 720*c*. As a result, the logic circuit 4 stops the operation of the booster circuit 2 through the drive circuit 3.

The voltage limiter circuit 620 and the drive section 100 constitute a voltage limit control section, and the ground detector circuit 640 and the drive section 100 constitute a low-voltage abnormality detection control section.

Figure 6:
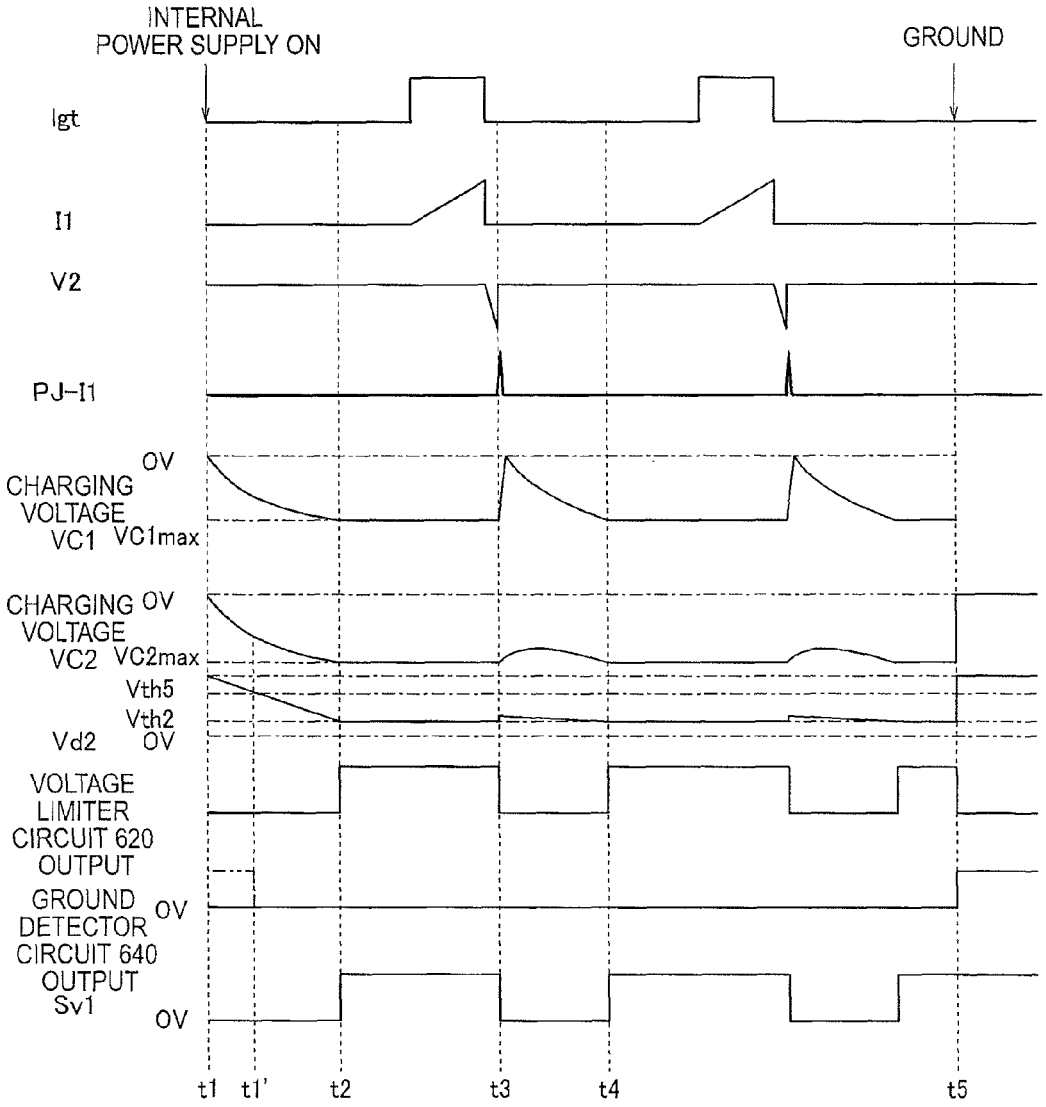
FIG. 6 is a timing chart illustrating the operation of the respective parts of the plasma ignition device at the time of a negative bias according to the first embodiment of the present invention.

FIG. 6 illustrates a timing chart of the operation of the respective parts of the plasma ignition device at the time of a negative bias according to the first embodiment of the present invention. Hereinafter, the operation is described. When the internal power supply 602 is turned on at a time point t1, the booster circuit 2 within the power supply circuit 520 starts the operation to charge the tank capacitor 8 and the PJ capacitor 300.

At a time point t2, when the charging voltage VC2 of the tank capacitor 8 reaches VC2max (in fact, −VC2max; the same is applied to the following description), the detection (divided) voltage Vd2 becomes equal to or lower than the reference voltage Vth2. As a result, the voltage limiter circuit 620 outputs the voltage detection signal of the H level, and the OR circuit 720 outputs the voltage detection signal Sv1 of the H level to stop the operation of the booster circuit 2.

At a time point t3, when the high voltage V2 is applied to the ignition plug 11 by the ignition coil 13 to cause breakdown, discharge starts. Electric energy is supplied from the power supply circuit 520 to a discharge space whose impedance is decreased by the discharge start, and the plasma is generated. As a result, the plasma current PJ-I1 is allowed to flow. The electric charges accumulated in the PJ capacitor 300 and the tank capacitor 8 are removed by allowing the plasma current PJ-I1 to flow. As a result, the charging voltage VC1 of the PJ capacitor 300 and the charging voltage VC2 of the tank capacitor 8 are decreased. Then, in the voltage limiter circuit 620, the detection voltage Vd2 exceeds the reference voltage Vth2, and the voltage limiter circuit 620 outputs the voltage detection signal of the L level. As a result, the OR circuit 720 outputs the voltage detection signal Sv1 of the L level to start the operation of the booster circuit 2.

At a time point t4, when the charging voltage VC2 of the tank capacitor 8 reaches VC2max, the detection voltage Vd2 becomes equal to or lower than the reference voltage Vth2, and the voltage limiter circuit 620 outputs the voltage detection signal of the H level. As a result, the OR circuit 720 outputs the voltage detection signal Sv1 of the H level to stop the operation of the booster circuit 2. After that, the above-mentioned operation is repeated.

After that, at a time point t5, when grounding occurs in the ignition plug 11, the charging voltage VC2 of the tank capacitor 8 is increased. As a result, the divided voltage Vd2 becomes equal to or higher than the reference voltage Vth5 of the ground detector circuit 640, and the ground detector circuit 640 outputs the voltage detection signal of the H level. As a result, the OR circuit 720 outputs the voltage detection signal Sv1 of the H level to stop the operation of the booster circuit 2.

With the above-mentioned system, at the time of occurrence of ground, the detection voltage Vd2 supplied to the ground detector circuit 640 becomes equal to or higher than the reference voltage Vth5. As a result, the abnormal output is detected, and the voltage detection signal Sv1 of the H level is output. Therefore, at the time of ground, the operation of the booster circuit 2 is stopped, thereby enabling the electronic parts such as the transformer 21 or the MOSFET 22 in the booster circuit 2 to be prevented from being broken down.

Second Embodiment

Figure 7:
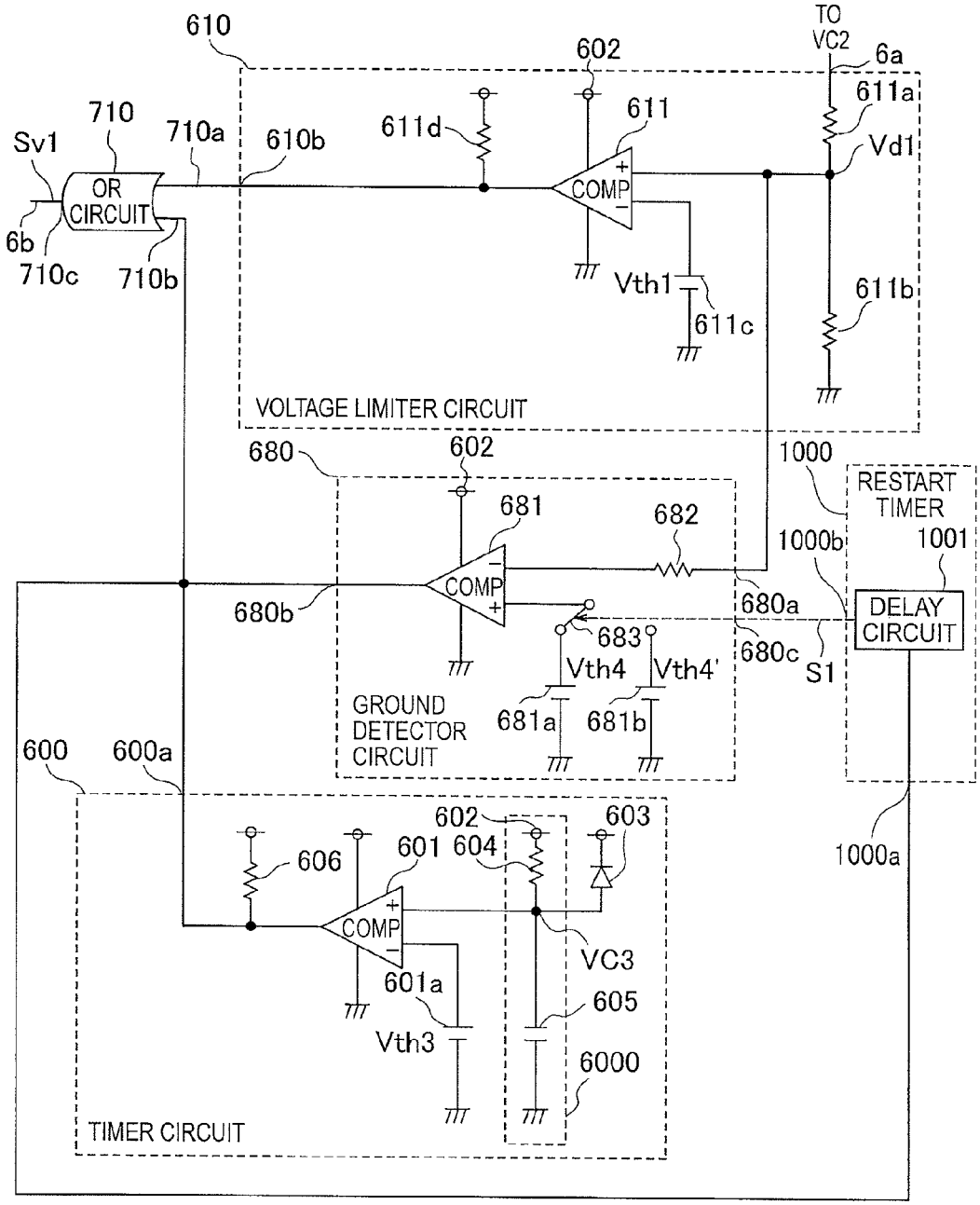
FIG. 7 is a diagram illustrating an example of the circuit configuration of the voltage detector circuit according to the second embodiment of the present invention.

The circuit configuration diagram of the plasma ignition device for an internal combustion engine according to the second embodiment of the present invention is identical with that illustrated in FIG. 1. However, the configuration of the voltage detector circuit is different from that of FIG. 1. FIG. 7 illustrates an example of the circuit configuration of a voltage detector circuit 63 according to this embodiment. A voltage detector circuit 63 illustrated in FIG. 7 is different from the voltage detector circuit 6 illustrated in FIG. 2 in that two reference power supplies 681*a* and 681*b* of reference voltages Vth4 and Vth4' (for example, Vth4'=−Vth4), and a switch 683 that selects any one of those reference power supplies and connects the selected reference power supply to an input terminal of a comparator 681 are disposed within a ground detector circuit 680. Further, a restart timer circuit 1000 for performing changeover of the switch 683 is newly disposed. The restart timer circuit 1000 may be formed of a delay circuit 1001 that outputs an input signal with a delay of a given period of time.

An input terminal 1000*a* of the restart timer circuit 1000 is connected to a connection point between an output terminal 680*b* of the ground detector circuit 680 and an output terminal 600*a* of the timer circuit 600, and an output terminal 1000*b* of the restart timer circuit 1000 is connected to a switch 683 within the ground detector circuit 680.

The operation until the ground detector circuit 680 detects the ground, and stops the operation of the booster circuit 2 is identical with those described in the first embodiment. When the ground detector circuit 680 detects the ground, and the voltage detection signal of the H level is input to the input terminal 1000*a*, the restart timer circuit 1000 inputs a voltage signal S1 of the H level to the switch 683 within the ground detector circuit 680 from the output terminal 1000*b* after an elapse of a given period of time. Upon receiving a signal of the H level from the restart timer circuit 1000, the switch 683 changes over the reference power supply to be connected to the comparator 681 from 681*a* to 681*b*. As a result, the reference voltage of the comparator 681 changes from Vth4 to Vth4', and the voltage detection signal from the output terminal 680*b* of the ground detector circuit 680 becomes the L level.

The switch 683 selects, when the voltage signal of the H level is not supplied thereto, the reference power supply 681*a* of the reference voltage Vth4, and connects the selected reference power supply 681*a* to the comparator 681. As a result, the voltage detection signal Sv1 of the OR circuit 710 becomes the L level, the voltage detection signal Sv1 of the L level is supplied to the logic circuit 4, and the booster circuit 2 restarts the operation. In this situation, when the ground state of the ignition plug 11 has been eliminated, the power supply circuit 510 returns to the normal operation.

The ground detector circuit 680 and the drive section 100 constitute a low-voltage abnormality detection control section, and the restart timer circuit 1000, the reference power supplies 681*a* and 681*b*, and the switch 683 constitute restart unit.

Figure 8:
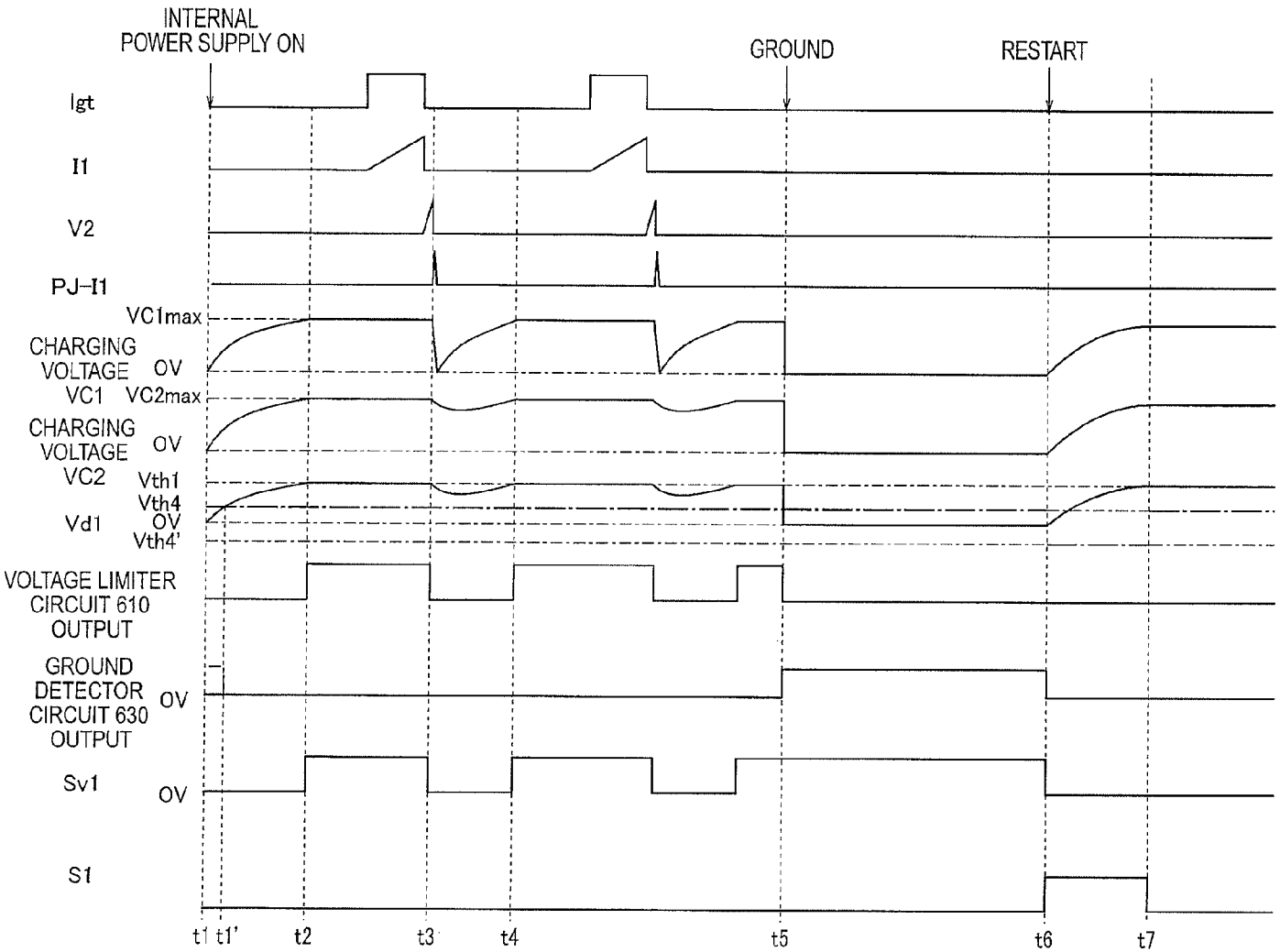
FIG. 8 is a timing chart illustrating an operation of the respective parts of the plasma ignition device according to the second embodiment of the present invention.

FIG. 8 illustrates a timing chart of the operation of the respective parts of the plasma ignition device according to the second embodiment of the present invention. Hereinafter, the operation is described. The operation at time points t1 to t4 is identical with that described in the above-mentioned first embodiment. At a time point t5, at the time of ground, when the voltage detection signal of the H level is supplied to the input terminal 1000*a* of the restart timer circuit 1000 from the ground detector circuit 680, the voltage signal S1 of the H level is supplied to the switch 683 from the output terminal 1000*b* at a time point t6 after a given period of time to change over the reference voltage of the comparator 681 from Vth4 to Vth4'. As a result, the detection voltage Vd1 becomes a value exceeding Vth4', the ground detector circuit 680 outputs the voltage detection signal of the L level, the OR circuit 710 inputs the voltage detection signal Sv1 of the L level to the logic circuit 4, and the booster circuit 2 starts the operation.

In this situation, when the ground state of the ignition plug 11 has been eliminated, the charging voltage VC2 of the tank capacitor 8 and the charging voltage VC3 of the PJ capacitor are increased. At a time point t7, the restart timer circuit 1000 inputs the voltage signal S1 of the L level to the switch 683, and the reference voltage changes over from Vth4' to Vth4.

When the ignition plug 11 has been returned to the normal state, the power supply circuit 510 is returned to the normal state. With this configuration, at the time of ground, the ground detector circuit 680 stops the operation of the booster circuit 2, thereby preventing electronic parts such as the transformer 21 or the FET 22 within the booster circuit 2 from being broken down. Further, when the ignition plug 11 has been returned to the normal state, the operation of the power supply circuit 510 is restored so that the power supply circuit 510 may again normally function.

The above-mentioned configuration may be applied to, for example, the plasma ignition device of the negative bias type illustrated in the first embodiment.

Third Embodiment

Figure 9:
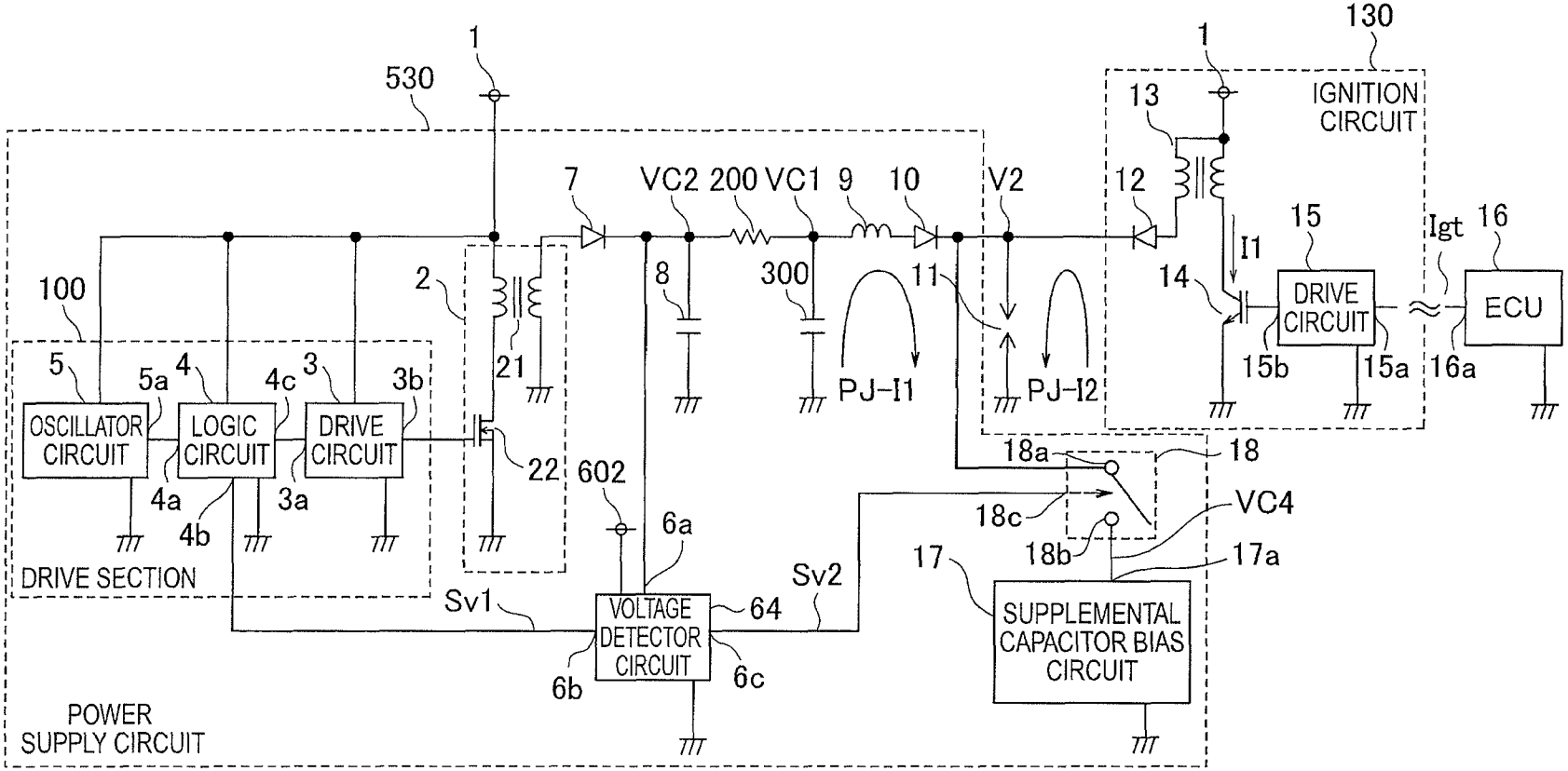
FIG. 9 is a circuit configuration diagram of a plasma ignition device for an internal combustion engine according to a third embodiment of the present invention.

FIG. 9 is a circuit configuration diagram of a plasma ignition device for an internal combustion engine according to a third embodiment of the present invention. Differences from the plasma ignition device illustrated in FIG. 1 reside in that a supplemental capacitor bias circuit 17 and a switch 18 are disposed within a power supply circuit 530.

Figure 10:
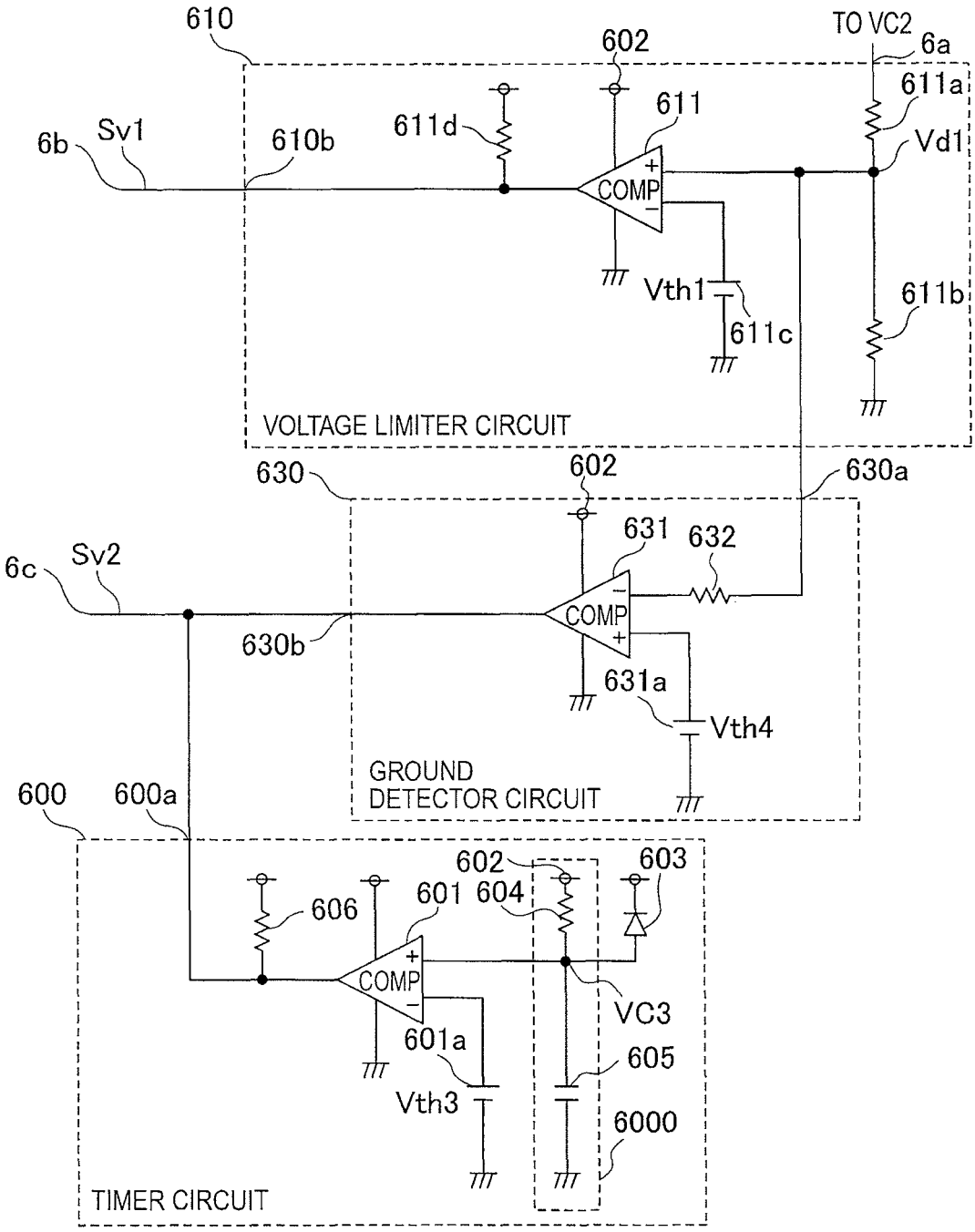
FIG. 10 is a diagram illustrating an example of a circuit configuration of a voltage detector circuit illustrated in FIG. 9.

FIG. 10 is a diagram illustrating an example of a circuit configuration of a voltage detector circuit 64 illustrated in FIG. 9. The voltage detector circuit 64 includes the voltage limiter circuit 610, the timer circuit 600, and the ground detector circuit 630.

An output terminal 6*b* of the voltage limiter circuit 610 is connected to the input terminal 4*b* of the logic circuit 4. An output terminal 6*c* of the ground detector circuit 630 is connected to an input terminal 18*c* of the switch 18 illustrated in FIG. 9. One contact 18*a* of the switch 18 is connected to a center electrode side of the ignition plug 11, and another contact 18*b* thereof is connected to an output terminal 17*a* of the supplemental capacitor bias circuit 17.

Figure 11:
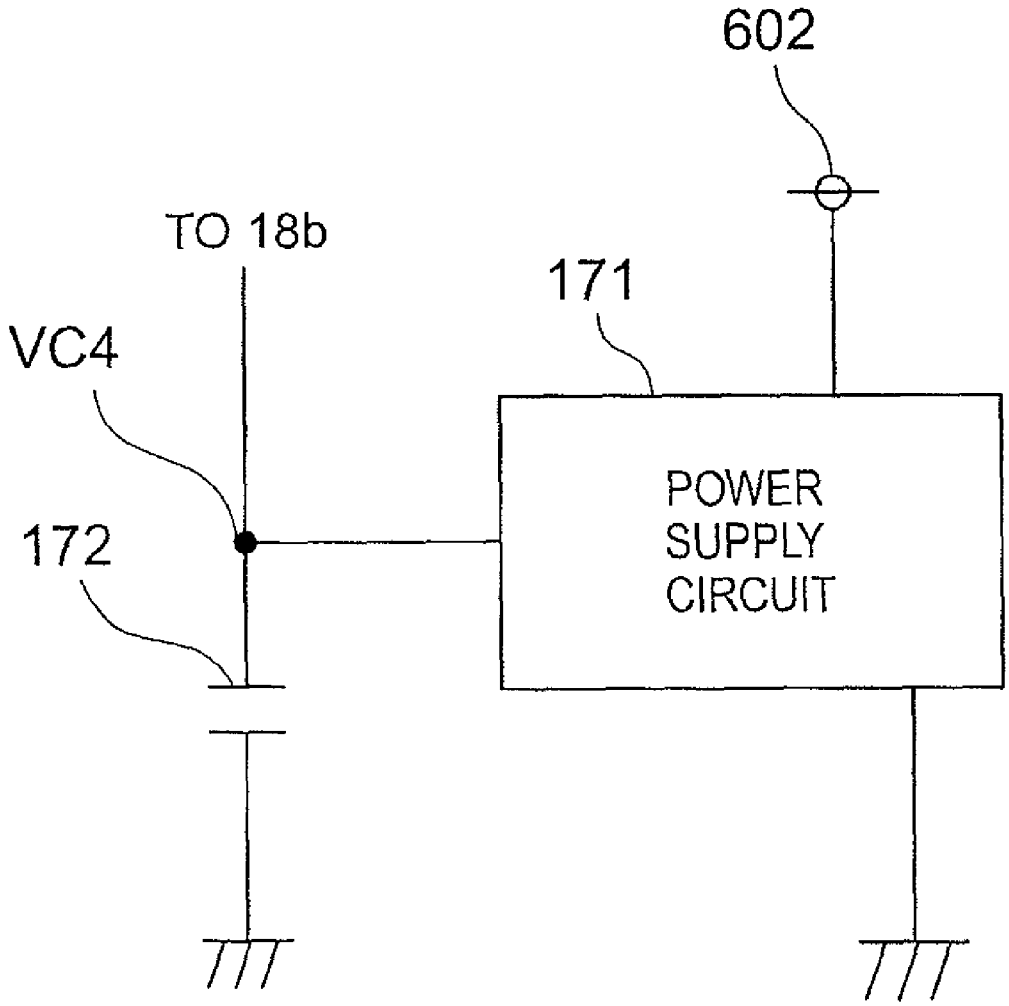
FIG. 11 is a diagram illustrating an example of the circuit configuration of a supplemental capacitor bias circuit illustrated in FIG. 9.

FIG. 11 is a diagram illustrating an example of the circuit configuration of the supplemental capacitor bias circuit 17. The supplemental capacitor bias circuit 17 includes a power supply circuit 171 using the internal power supply 602 as a power supply, and a supplemental capacitor 172. A charging voltage VC4 of the supplemental capacitor 172 which is charged by the power supply circuit 171 is set to be extremely larger than the charging voltage VC1 of the PJ capacitor 300. Further, a capacitance value of the supplemental capacitor 172 is set to be extremely larger than that of the PJ capacitor 300.

The ground detector circuit 630, the supplemental capacitor bias circuit 17, and the switch 18 constitute a low-voltage abnormality detection control section.

Figure 12:
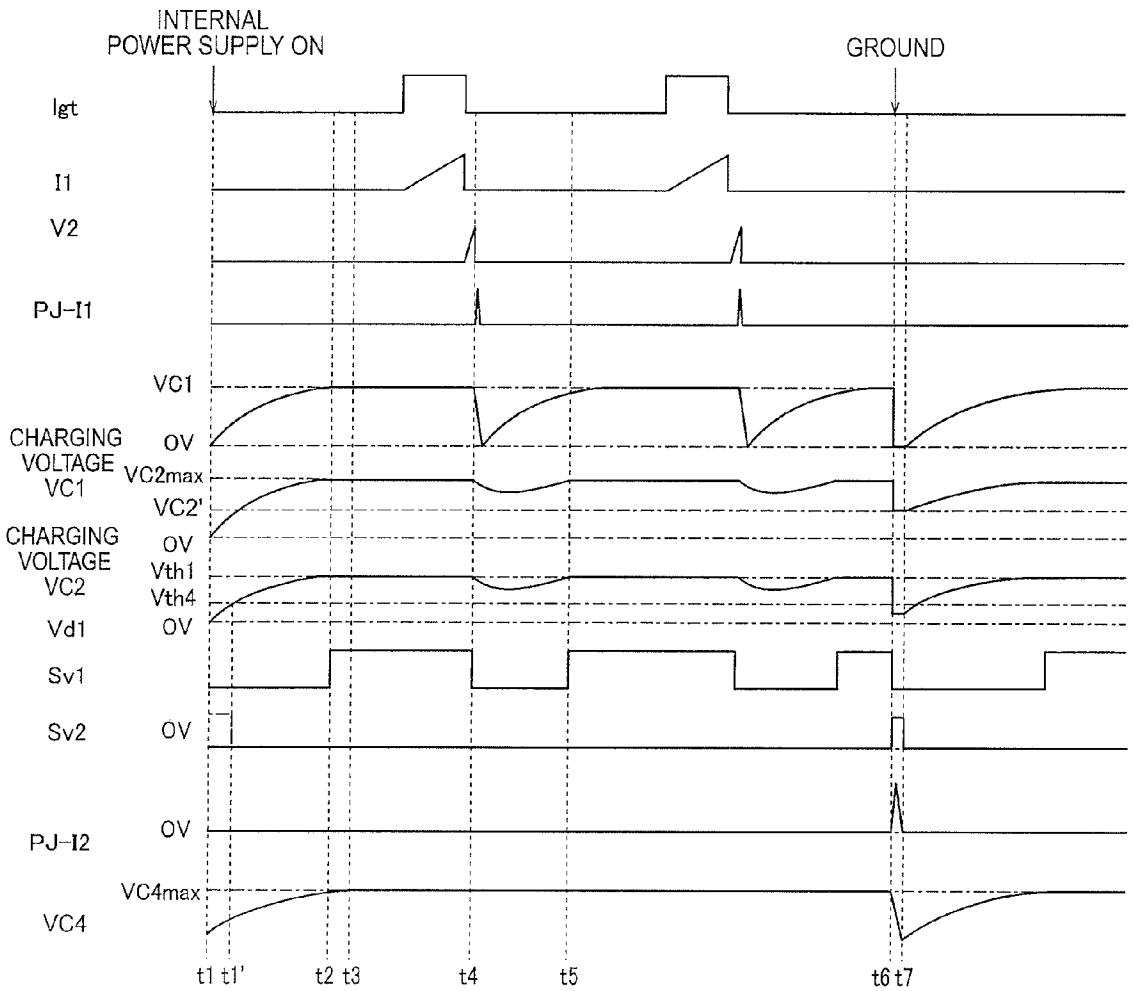
FIG. 12 is a timing chart illustrating the operation of the respective parts of the plasma ignition device according to the third embodiment of the present invention.

FIG. 12 illustrates a timing chart of the operation of the respective parts of the plasma ignition device according to the third embodiment of the present invention. Hereinafter, the operation is described. At a time point t1, after the internal power supply 602 has been turned on, in the supplemental capacitor bias circuit 17, the power supply circuit 171 starts the operation to charge the supplemental capacitor 172 (charging voltage VC4). After that, at a time point t3, the charging of the supplemental capacitor 172 is completed. The operation of other circuits at the time points t1 to t5 is identical with that in the first embodiment.

At a time point t6, when the ignition plug 11 comes to the ground state, the detection voltage Vd1 becomes equal to or lower than the reference voltage Vth4, and the ground detector circuit 630 inputs the voltage signal Sv2 of the H level to the input terminal 18*c* of the switch 18. As a result, the switch 18 is turned on, and electric charges accumulated in the supplemental capacitor 172 flows into the ignition plug 11 as the plasma current PJ-I2, and the ignition plug 11 which has been soiled with gasoline or the like is returned to the normal state. As a result, from a time point t7, the power supply circuit 530 may be returned to the normal state. In this situation, because the ignition plug 11 is returned to the normal state, the ground detector circuit 630 supplies the output voltage Sv2 of the L level to the input terminal 18*c* of the switch 18, and the switch 18 is turned off.

With the above-mentioned configuration, the ignition plug 11 that has been soiled with gasoline or the like and come to the ground state is returned to the normal state, thereby enabling the power supply circuit 530 to normally operate.

The above-mentioned configuration may be applied to, for example, the plasma ignition device of the negative bias type illustrated in the first embodiment.

Fourth Embodiment

Figure 13:
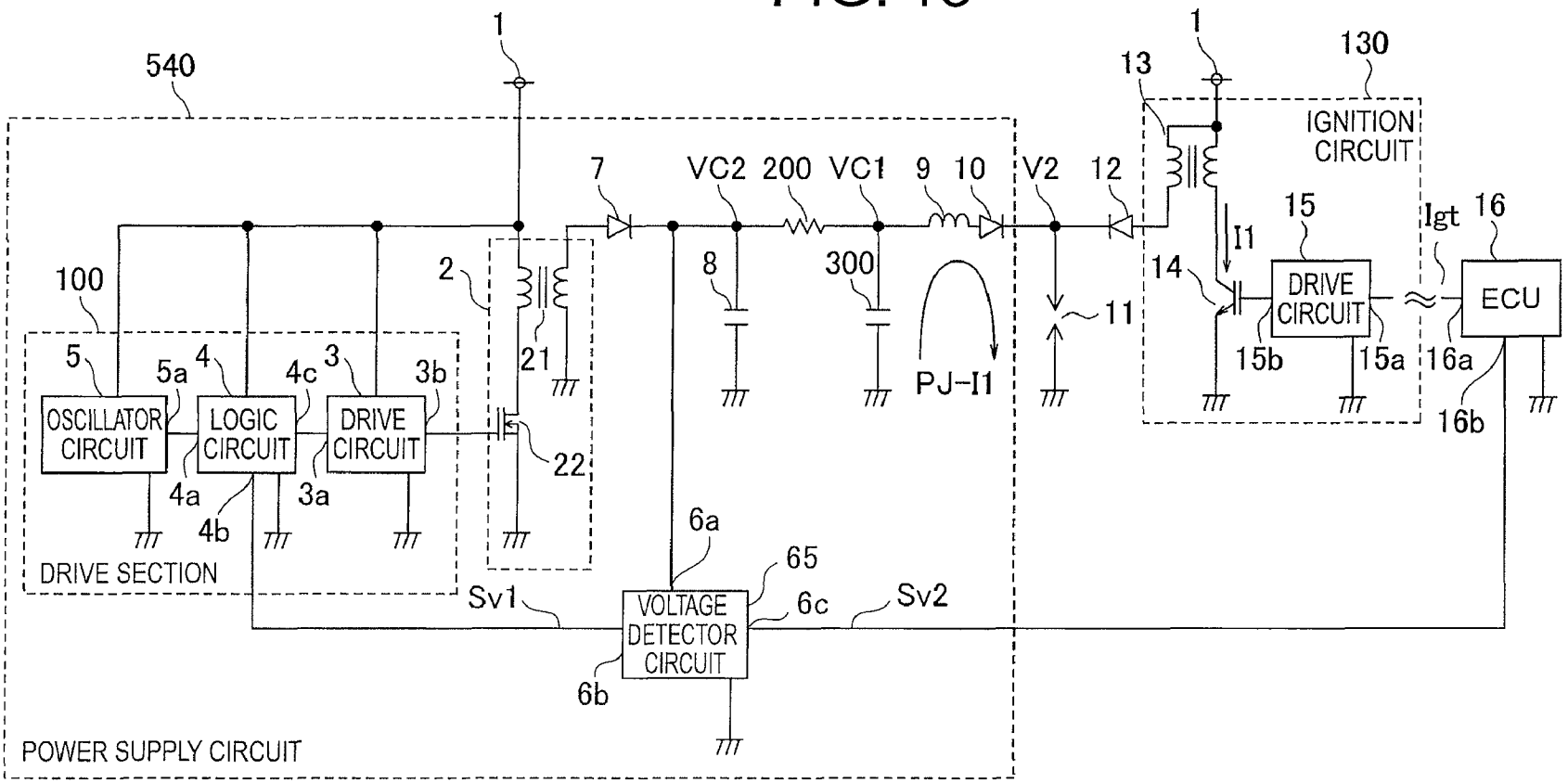
FIG. 13 is a circuit configuration diagram of a plasma ignition device for an internal combustion engine according to a fourth embodiment of the present invention.
Figure 14:
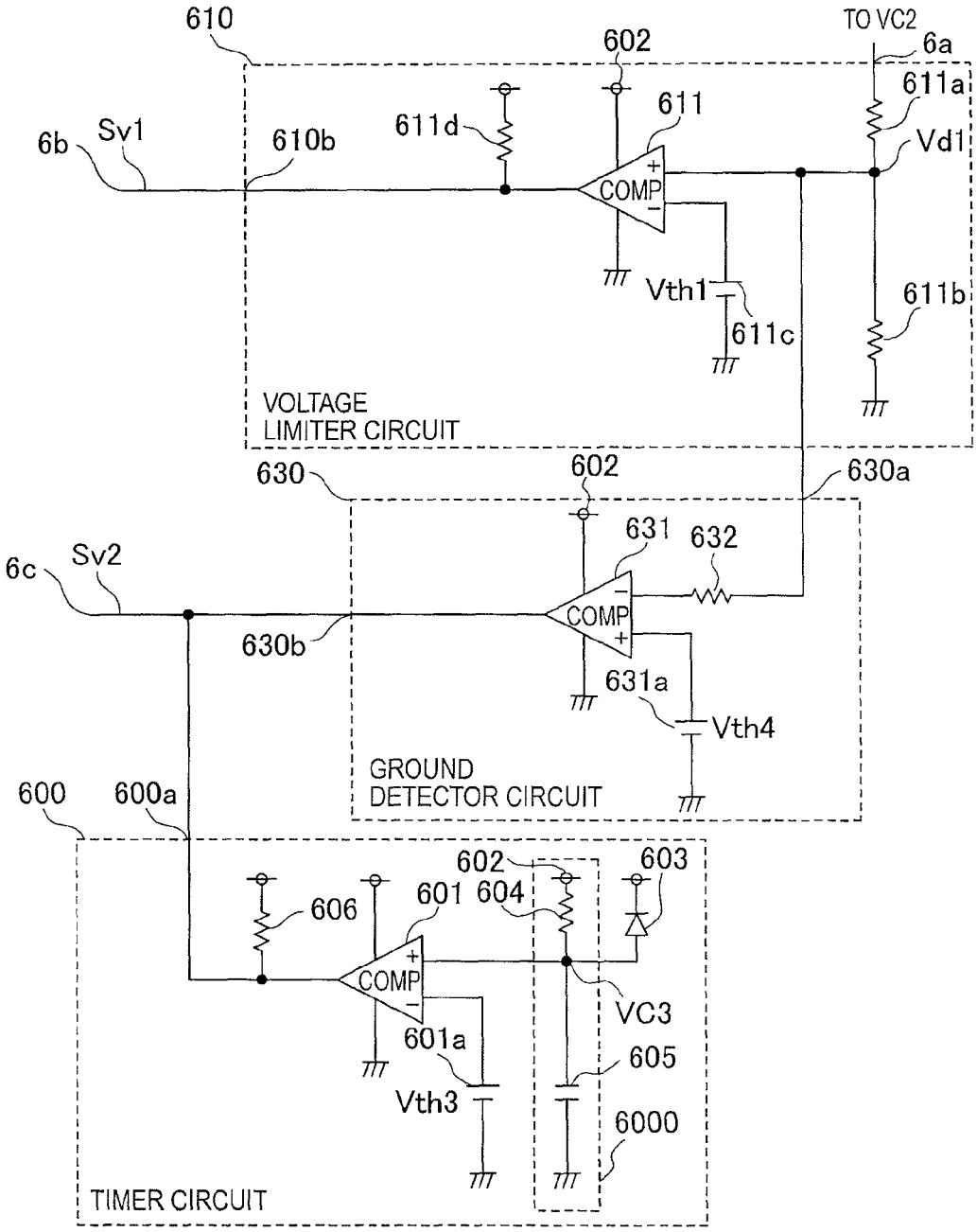
FIG. 14 is a diagram illustrating an example of a circuit configuration of a voltage detector circuit illustrated in FIG. 13.

FIG. 13 is a circuit configuration diagram of a plasma ignition device for an internal combustion engine according to a fourth embodiment of the present invention. FIG. 14 is a diagram illustrating an example of a circuit configuration of a voltage detector circuit 65 within a power supply circuit 540 illustrated in FIG. 13. Differences from the plasma ignition device illustrated in FIG. 1 reside in that the output terminal 6*b* of the voltage limiter circuit 610 of the voltage detector circuit 65 illustrated in FIG. 14 is connected to the input terminal 4*b* of the logic circuit 4, and the output terminal 6*c* of the ground detector circuit 630 is connected to an input terminal 16*b* of the ECU 16.

The ground detector circuit 630 and the ECU 16 constitute a low-voltage abnormality detection control section.

Figure 15:
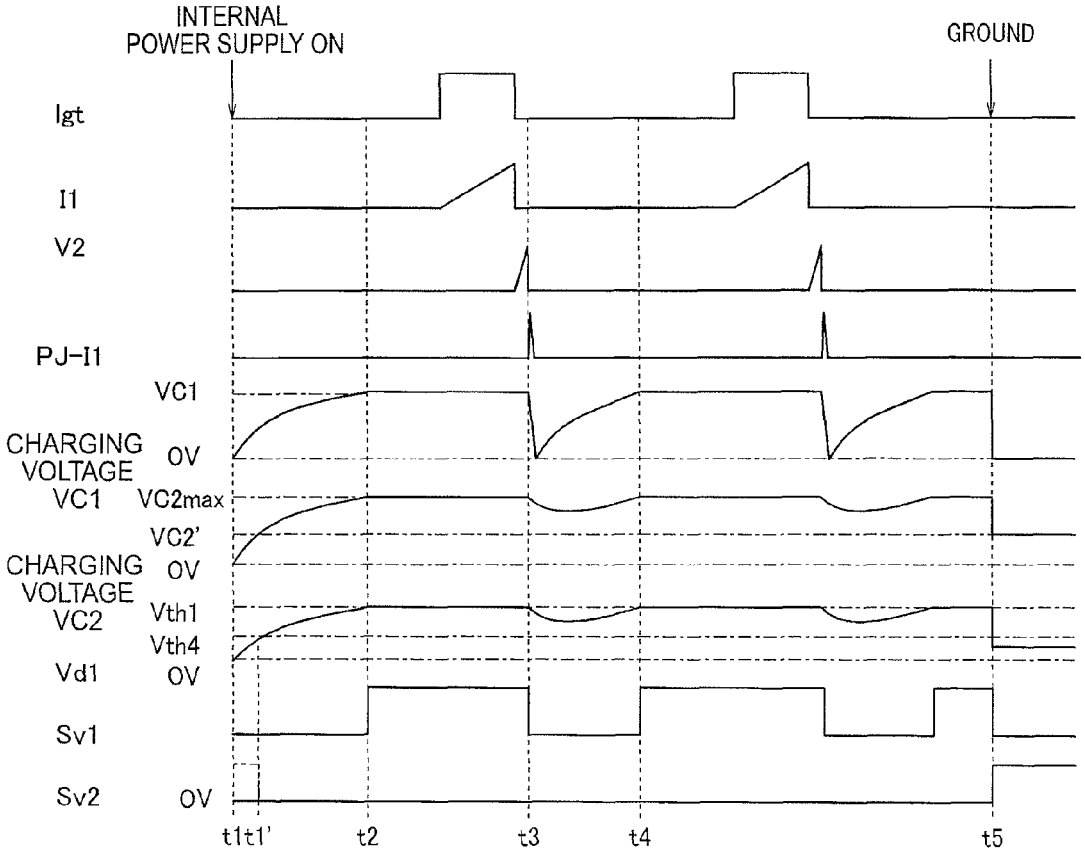
FIG. 15 is a timing chart illustrating an operation of the respective parts of the plasma ignition device according to the fourth embodiment of the present invention.

FIG. 15 illustrates a timing chart of the operation of the respective parts of the plasma ignition device according to the fourth embodiment of the present invention. Hereinafter, the operation is described. The operation at time points t1 to t4 is identical with that described in the above-mentioned first embodiment.

At a time point t5, at the time of ground, the ground detector circuit 630 inputs the voltage signal Sv2 of the H level indicating the ground occurrence from the output terminal 6*c* to the input terminal 16*b* of the ECU 16 as a fail-safe signal. As a result, the ECU 16 detects that the ignition plug 11 is grounded because the ignition plug 11 is covered with gasoline or the like. The ECU 16 that has detected the ground controls an internal combustion engine so as to stop the operation of the booster circuit 2 within the power supply circuit 540 (for example, drive stop control for the internal combustion engine). With this operation, electronic parts such as the transformer 21 or the FET 22 within the booster circuit 2 may be prevented from being broken down.

The above-mentioned configuration may be applied to, for example, the plasma ignition device of the negative bias type illustrated in the first embodiment.

Fifth Embodiment

Figure 16:
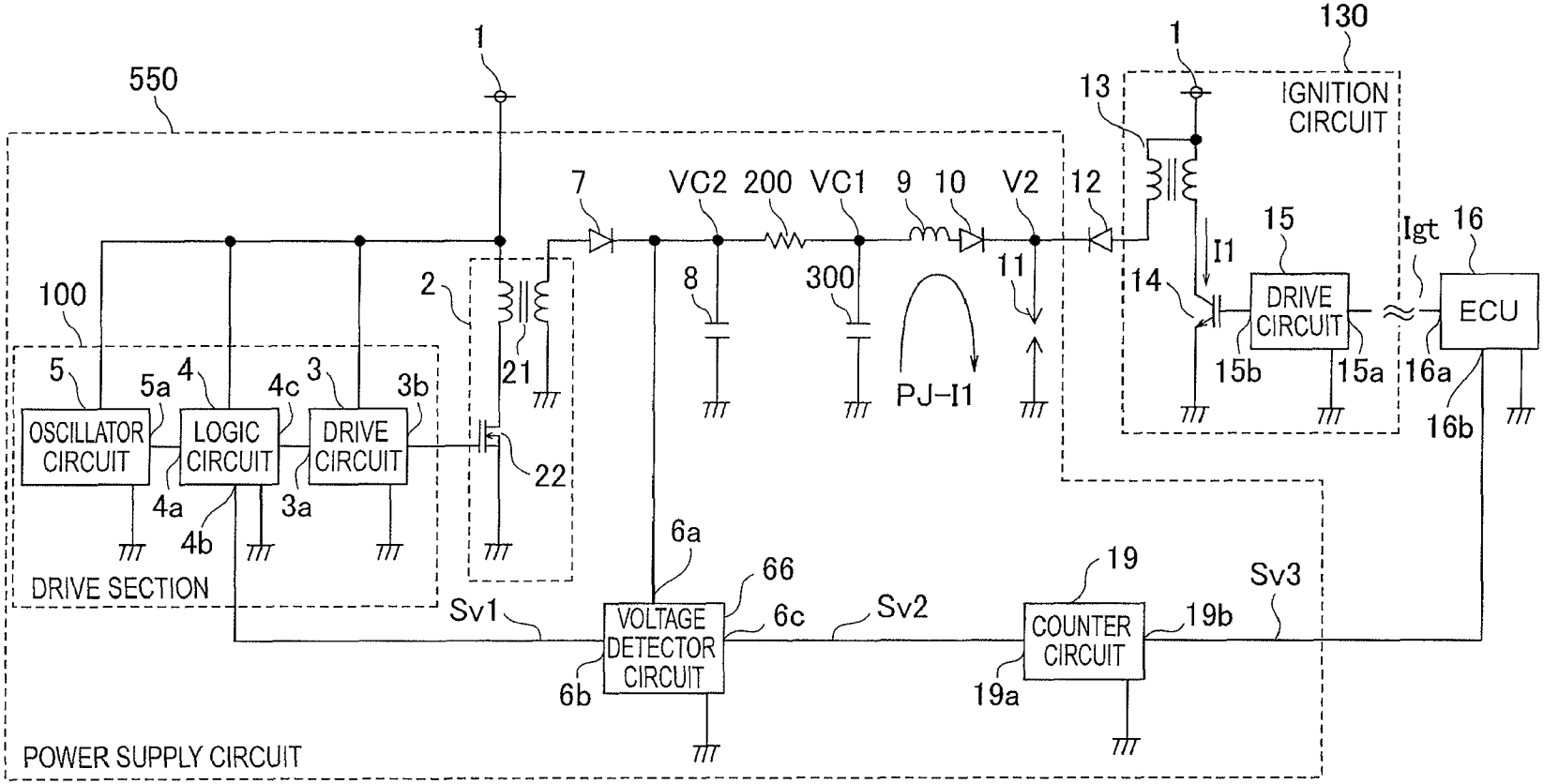
FIG. 16 is a circuit configuration diagram of a plasma ignition device for an internal combustion engine according to a fifth embodiment of the present invention.
Figure 17:
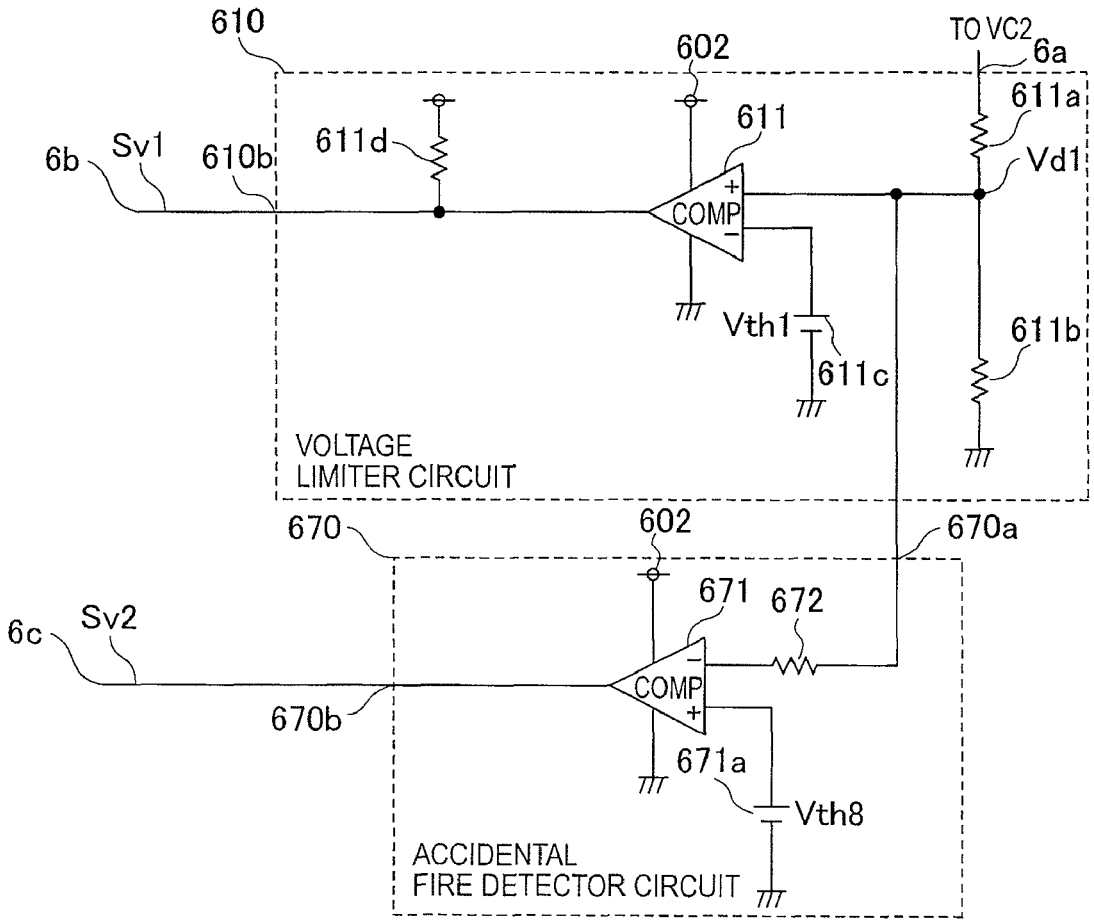
FIG. 17 is a diagram illustrating an example of a circuit configuration of a voltage detector circuit illustrated in FIG. 16.

FIG. 16 is a circuit configuration diagram of a plasma ignition device for an internal combustion engine according to a fifth embodiment of the present invention. FIG. 17 is a diagram illustrating an example of a circuit configuration of a voltage detector circuit 66 within a power supply circuit 550 illustrated in FIG. 16. Differences from the above-mentioned fourth embodiment reside in that a voltage detector circuit 66 and a counter circuit 19 are disposed within a power supply circuit 550 in FIG. 16. Further, the ground detector circuit 630 and the timer circuit 600 within the voltage detector circuit 65 in FIG. 14 function as an accidental fire detector circuit 670 in the voltage detector circuit 66 of FIG. 17. The voltage detector circuit 66 includes the voltage limiter circuit 610 and the accidental fire detector circuit 670.

The output terminal 6*b* of the voltage limiter circuit 610 is connected to the input terminal 4*b* of the logic circuit 4. An input terminal 670*a* of the accidental fire detector circuit 670 is connected to a connection point (divided voltage Vd1) of series resistors 611*a* and 611*b* of the voltage limiter circuit 610, and the output terminal 6*c* thereof is connected to an input terminal 19*a* of the counter circuit 19. An output terminal 19*b* of the counter circuit 19 is connected to the input terminal 16*b* of the ECU 16.

The accidental fire detector circuit 670 illustrated in FIG. 17 includes a comparator 671, an input resistor 672, and a reference power supply 671*a* of a reference voltage Vth8. To one input terminal of the comparator 671 connected between the internal power supply 602 and the ground terminal GND is input the divided voltage Vd1 of the charging voltage VC2 across the tank capacitor 8, which has been divided by the series resistors 611*a* and 611*b* of the voltage limiter circuit 610 through an input resistor 672, and to another input terminal of the comparator 671 is input a reference voltage Vth8 of the reference power supply 671*a*. When the divided voltage Vd1 becomes equal to or lower than the reference voltage Vth8, the comparator 671 inputs the voltage detection signal Sv2 of the H level to the input terminal 19*a* of the counter circuit 19 from the output terminal 6*c* of the accidental fire detector circuit 670.

After that, when the counter circuit 19 continuously receives the voltage detection signal Sv2 of the L level for a predetermined period of time t limit or longer, the counter circuit 19 inputs the voltage signal Sv3 of the H level to the input terminal 16*b* of the ECU 16 from the output terminal 19*b*. As a result, the ECU 16 detects that the ignition plug 11 is in an accidental fire state.

The accidental fire detector circuit 670, the counter circuit 19, and the ECU 16 constitute an accidental fire detection section.

Figure 18:
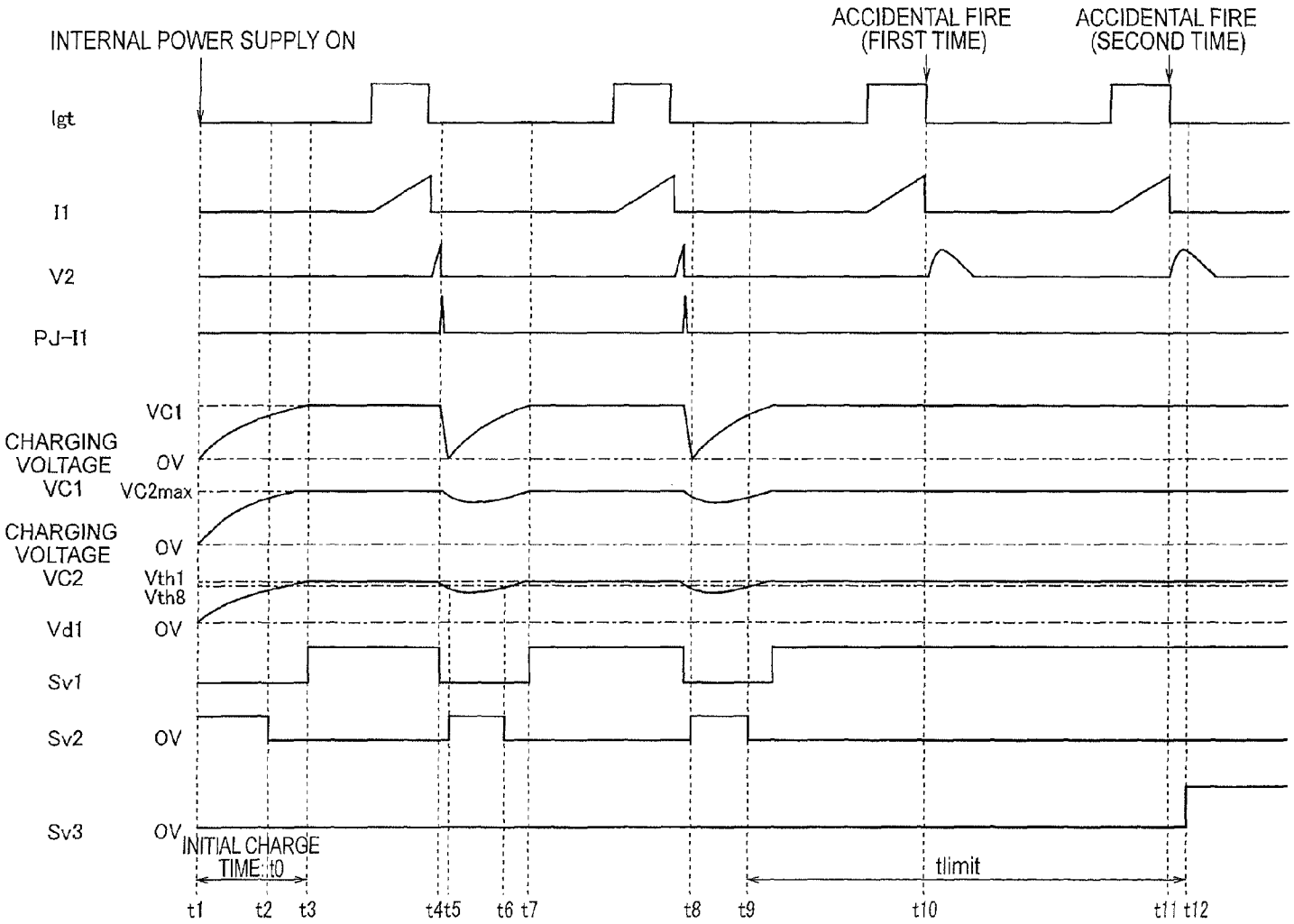
FIG. 18 is a timing chart illustrating an operation of the respective parts of the plasma ignition device according to the fifth embodiment of the present invention.

FIG. 18 illustrates a timing chart of the operation of the respective parts of the plasma ignition device according to the fifth embodiment of the present invention. Hereinafter, the operation is described. At a time point t1, when the internal power supply 602 is turned on, the voltage detection signal Sv2 of the H level is supplied to the counter circuit 19 until a time point t2 at which the divided voltage Vd1 exceeds the reference voltage Vth8 in the accidental detector circuit 670.

After that, at a time point t4, when the plasma current PJ-I1 is discharged, the charging voltage VC2 of the tank capacitor 8 is decreased. The voltage detection signal Sv2 of the H level is output from a time point t5 at which the divided voltage Vd1 becomes equal to or lower than Vth8 to a time point t6 at which the divided voltage Vd1 exceeds the reference voltage Vth8. After that, the above-mentioned operation is repeated till a time point t9.

After that, when the ignition plug 11 repeats the accidental fire operation at time points t10 and t11, and the voltage detection signal Sv2 of the H level is not output for the given period of time t limit or longer from the time point t9 to the time point t12, the counter circuit 19 outputs the voltage detection signal Sv3 of the H level to the ECU 16 as a fail-safe signal at a time point t12. With the above-mentioned operation, the ECU 16 detects that the ignition plug 11 is in the accidental fire state.

With the above-mentioned configuration, when the ECU 16 detects the accidental fire, the ECU 16 controls the internal combustion engine so as to stop the operation of the ignition coil 13 (for example, the drive stop control for the internal combustion engine). As a result, the backward voltage applied to the high-voltage diode 10 is suppressed, thereby enabling a load on the high-voltage diode 10 to be reduced.

The above-mentioned configuration may be applied to, for example, the plasma ignition device of the negative bias type illustrated in the first embodiment.

Sixth Embodiment

Figure 19:
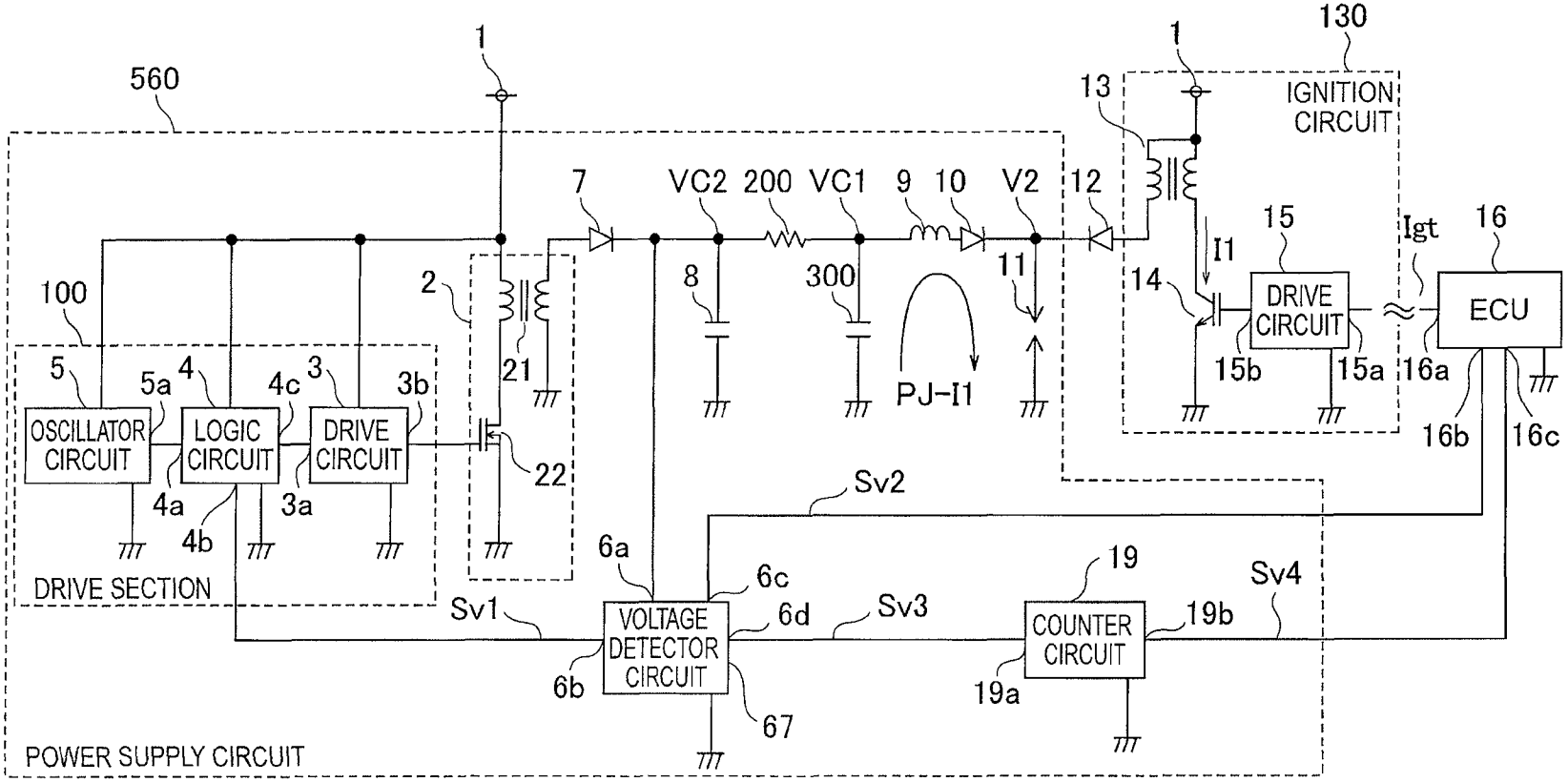
FIG. 19 is a circuit configuration diagram of a plasma ignition device for an internal combustion engine according to a sixth embodiment of the present invention.
Figure 20:
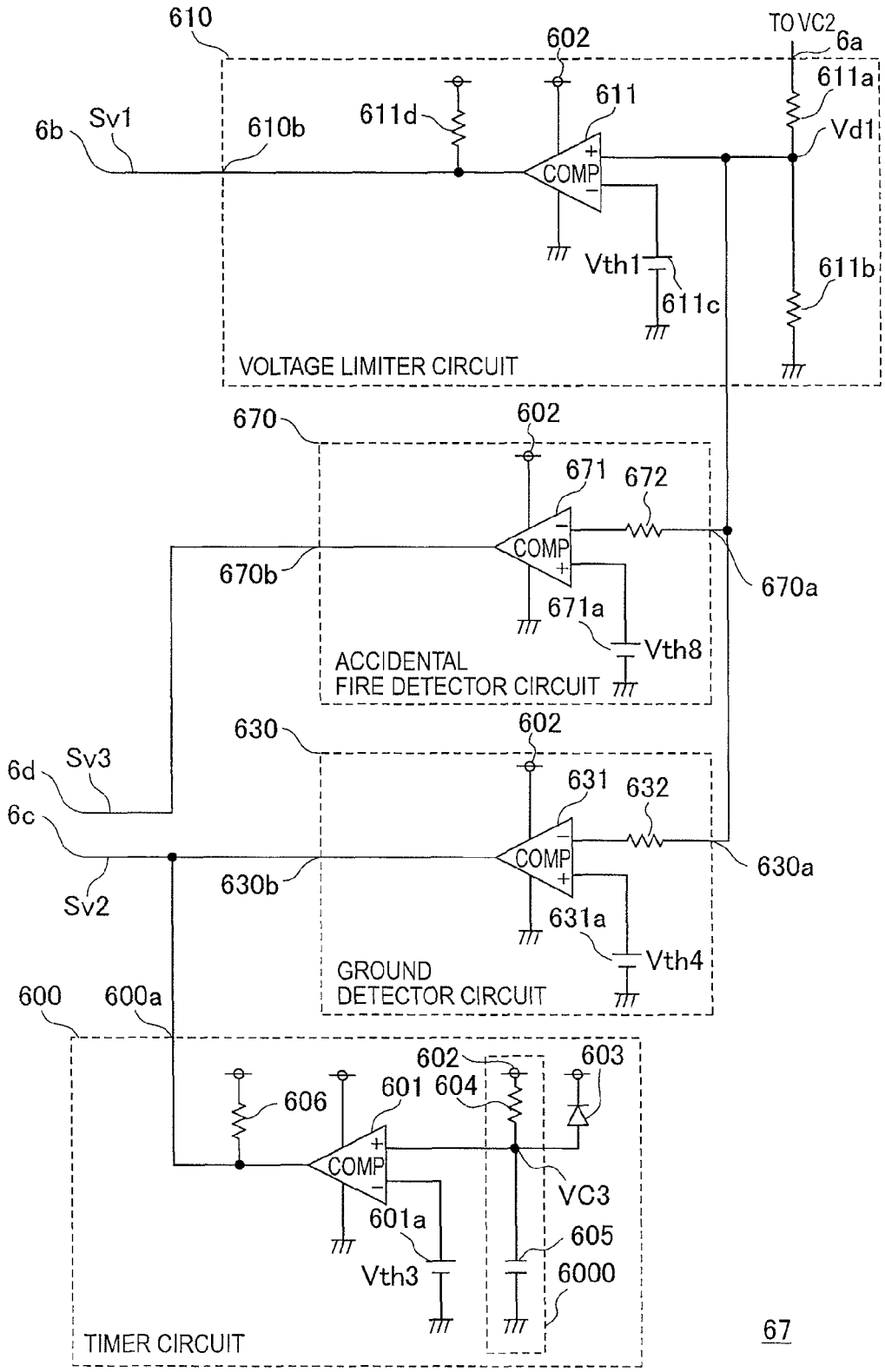
FIG. 20 is a diagram illustrating an example of a circuit configuration of a voltage detector circuit illustrated in FIG. 19.

FIG. 19 is a circuit configuration diagram of a plasma ignition device for an internal combustion engine according to a sixth embodiment of the present invention. FIG. 20 is a diagram illustrating an example of a circuit configuration of a voltage detector circuit 67 within a power supply circuit 560 illustrated in FIG. 19. The voltage detector circuit 67 is configured by the combination of the voltage limiter circuit 610, the ground detector circuit 630, and the timer circuit 600 according to the fourth embodiment illustrated in FIG. 14 with the accidental fire detector circuit 670 according to the fifth embodiment illustrated in FIG. 17. Further, the counter circuit 19 according to the fifth embodiment is disposed within the power supply circuit 560 of FIG. 19.

In the voltage detector circuit 67 illustrated in FIGS. 19 and 20, the output terminal 6*b* of the voltage limiter circuit 610 is connected to the input terminal 4*b* of the logic circuit 4. The output terminal 6*d* of the accidental fire detector circuit 670 is connected to the input terminal 19*a* of the counter circuit 19, and the output terminal 19*b* of the counter circuit 19 is connected to the input terminal 16*c* of the ECU 16. The output terminal 6*c* of the ground detector circuit 630 is connected to the input terminal 16*b* of the ECU 16.

Upon detecting the ground of the ignition plug 11, the ground detector circuit 630 outputs the voltage detection signal Sv2 to the ECU 16 as a fail-safe signal. When the accidental fire detector circuit 670 and the counter circuit 19 detect the accidental fire of the ignition plug 11, the counter circuit 19 outputs the voltage detection signal Sv4 to the ECU 16 as a fail-safe signal. As a result, the ECU 16 detects that the ignition plug 11 is grounded or in the accidental fire state.

The above-mentioned configuration is obtained by the combination of the functions of the devices described in the sixth and seventh embodiments. With the configuration, when the ECU 16 detects the ground, the control for stopping the operation of the booster circuit 2 within the power supply circuit 550 is conducted, thereby preventing electronic parts such as the transformer 21 or the FET 22 within the booster circuit 2 from being broken down. Further, when the ECU 16 detects the accidental fire, the control for stopping the operation of the ignition coil 13 is conducted, thereby suppressing the backward voltage applied to the high-voltage diode 10, which enables a load on the high-voltage diode 10 to be reduced.

The above-mentioned configuration may be also applied to, for example, the plasma ignition device of the negative bias type illustrated in the first embodiment.

Further, the present invention is not limited to the above-mentioned respective embodiments, but may include all of the potential combinations of those embodiments.

What is claimed is:

1. A plasma ignition device for an internal combustion engine, comprising:

an ignition plug for the internal combustion engine;

an ignition circuit that is connected in parallel to said ignition plug, and applies a high voltage to said ignition plug to start discharge; and a power supply circuit that is connected in parallel to said ignition plug, comprising a battery section that generates a plasma current for supplying an electric energy to a discharge space of said ignition plug having impedance reduced by discharge start, and a charging section that charges said battery section with a voltage boosted by a booster circuit, wherein said power supply circuit comprises:

a voltage limit control section that stops a boosting operation of said booster circuit when a voltage of said charging section is equal to or higher than a first reference voltage for high-voltage abnormality detection as a result of comparison with the first reference voltage;

a low-voltage abnormality detection control section that detects an abnormal voltage of said charging section by comparison with a second reference voltage for low-voltage abnormality detection for detecting ground to conduct a given control on said power supply circuit; and a control limiter section that invalidates the given control of said low-voltage abnormality detection control section until said charging section is sufficiently charged.

2. The plasma ignition device for an internal combustion engine according to claim 1, wherein said control limiter section comprises a timer circuit that invalidates the given control of said low-voltage abnormality detection control section for a first given period of time until said charging section is sufficiently charged.

3. The plasma ignition device for an internal combustion engine according to claim 1, wherein when said low-voltage abnormality detection control section detects the abnormal voltage, said low-voltage abnormality detection control section conducts the given control on said power supply circuit by latch operation, and maintains a state where said power supply circuit is controlled.

4. The plasma ignition device for an internal combustion engine according to claim 2, wherein when said low-voltage abnormality detection control section detects the abnormal voltage, said low-voltage abnormality detection control section conducts the given control on said power supply circuit by latch operation, and maintains a state where said power supply circuit is controlled.

5. The plasma ignition device for an internal combustion engine according to claim 1, wherein said power supply circuit comprises a restart unit that forcedly cancels the given control a second given period of time after said low-voltage abnormality detection control section conducts the given control.

6. The plasma ignition device for an internal combustion engine according to claim 2, wherein said power supply circuit comprises a restart unit that forcedly cancels the given control a second given period of time after said low-voltage abnormality detection control section conducts the given control.

7. The plasma ignition device for an internal combustion engine according to claim 1, wherein said low-voltage abnormality detection control section stops the boosting operation of said booster circuit when detecting the abnormal voltage.

8. The plasma ignition device for an internal combustion engine according to claim 2, wherein said low-voltage abnormality detection control section stops the boosting operation of said booster circuit when detecting the abnormal voltage.

9. The plasma ignition device for an internal combustion engine according to claim 1, wherein said low-voltage abnormality detection control section comprises:

a ground detector circuit that outputs a voltage detection signal when detecting the abnormal voltage;

a supplemental capacitor bias circuit comprising a supplemental capacitor and a power supply circuit that charges said supplemental capacitor; and a switch that connects said supplemental capacitor which is charged when receiving a voltage detection signal of said low-voltage abnormality detection control section, in parallel to said ignition plug.

10. The plasma ignition device for an internal combustion engine according to claim 2, wherein said low-voltage abnormality detection control section comprises:

a ground detector circuit that outputs a voltage detection signal when detecting the abnormal voltage;

a supplemental capacitor bias circuit comprising a supplemental capacitor and a power supply circuit that charges said supplemental capacitor; and a switch that connects said supplemental capacitor which is charged when receiving a voltage detection signal of said low-voltage abnormality detection control section, in parallel to said ignition plug.

11. The plasma ignition device for an internal combustion engine according to claim 1, wherein said low-voltage abnormality detection control section outputs a fail-safe signal for stopping the boosting operation of said booster circuit, to an ECU of the internal combustion engine when detecting the abnormal voltage.

12. The plasma ignition device for an internal combustion engine according to claim 2, wherein said low-voltage abnormality detection control section outputs a fail-safe signal for stopping the boosting operation of said booster circuit, to an ECU of the internal combustion engine when detecting the abnormal voltage.

13. The plasma ignition device for an internal combustion engine according to claim 1, wherein said power supply circuit comprises:

an accidental fire detector circuit that detects an abnormal voltage of said charging section by comparison with a third reference voltage for accidental fire detection in said ignition plug to output a voltage detection signal; and a counter circuit that outputs a fail-safe signal for stopping an ignition operation of said ignition circuit, to an ECU of the internal combustion engine when continuously receiving the voltage detection signal from said accidental fire detection section for a third given period of time.

14. The plasma ignition device for an internal combustion engine according to claim 2, wherein said power supply circuit comprises:

an accidental fire detector circuit that detects an abnormal voltage of said charging section by comparison with a third reference voltage for accidental fire detection in said ignition plug to output a voltage detection signal; and a counter circuit that outputs a fail-safe signal for stopping an ignition operation of said ignition circuit, to an ECU of the internal combustion engine when continuously receiving the voltage detection signal from said accidental fire detection section for a third given period of time.

15. A plasma ignition device for an internal combustion engine, comprising:

an ignition plug for the internal combustion engine;

an ignition circuit that is connected in parallel to said ignition plug, and applies a high voltage to said ignition plug to start discharge; and a power supply circuit that is connected in parallel to said ignition plug, comprising a battery section that generates a plasma current for supplying an electric energy to a discharge space of said ignition plug whose impedance is reduced by discharge start, and a charging section that charges said battery section with a voltage boosted by a booster circuit, wherein said power supply circuit comprises:

a voltage limit control section that stops a boosting operation of said booster circuit when a voltage of said charging section is equal to or higher than a first reference voltage for high-voltage abnormality detection as a result of comparison with the first reference voltage; and an accidental fire detector circuit that detects an abnormal voltage of said charging section by comparison with a second reference voltage for accidental fire detection in said ignition plug to output a fail-safe signal for stopping an ignition operation of said ignition circuit, to an ECU of the internal combustion engine when an abnormality detection is continued for a given period of time.

* * * * *